US011346199B2

(12) United States Patent
Chen et al.

(10) Patent No.: US 11,346,199 B2
(45) Date of Patent: May 31, 2022

(54) FLUID SEPARATING DEVICE

(71) Applicant: Shuhao Liu, Sichuan (CN)

(72) Inventors: Junhong Chen, Sichuan (CN); Shufei Liu, Sichuan (CN); Shice Su, Sichuan (CN); Hansen Liu, Sichuan (CN); Xiangmeike Liu, Sichuan (CN)

(73) Assignee: CHENGDU BISON TECHNOLOGY CO., LTD., Chengdu (CN)

( * ) Notice: Subject to any disclaimer, the term of this patent is extended or adjusted under 35 U.S.C. 154(b) by 222 days.

(21) Appl. No.: 16/643,530

(22) PCT Filed: Sep. 5, 2018

(86) PCT No.: PCT/CN2018/104237
§ 371 (c)(1),
(2) Date: Feb. 29, 2020

(87) PCT Pub. No.: WO2019/047870
PCT Pub. Date: Mar. 14, 2019

(65) Prior Publication Data

US 2020/0190955 A1 Jun. 18, 2020

(30) Foreign Application Priority Data

Sep. 6, 2017 (CN) ..... 201710794285.4

(51) Int. Cl.
*E21B 7/28* (2006.01)
*E21B 17/10* (2006.01)
(Continued)

(52) U.S. Cl.
CPC ..... *E21B 43/38* (2013.01)

(58) Field of Classification Search
None
See application file for complete search history.

(56) References Cited

U.S. PATENT DOCUMENTS 4,395,474 A * 7/1983 Kondo ..... G03G 5/0553 430/96
4,471,843 A * 9/1984 Jones, Jr ..... E21B 7/06 175/73

(Continued)

FOREIGN PATENT DOCUMENTS

CN 104929561 A 9/2015
CN 105804689 A 7/2016

(Continued)

*Primary Examiner* — Matthew Troutman
*Assistant Examiner* — Douglas S Wood
(74) *Attorney, Agent, or Firm* — Chieh-Mei Wang

(57) ABSTRACT

A fluid separating device comprises: a cylinder; a plurality of separators disposed around a cylinder; a first elastic piece disposed between one of the separators and the cylinder and applying an elastic force to the separator outwardly in the radial direction of the cylinder; a first guiding device passing through the cylinder axially and configured to reciprocate between an expanded position and a contracted position in the axial direction of the cylinder; a second guiding device penetrating the cylinder, connected to the separator at one end, and slidably fitted with the first guiding device at the other end via a fitting surface. The fluid separating device eliminates the friction between the separator and the inner wall of the wellhole when descending, therefore descending to the bottom of the well quickly.

9 Claims, 24 Drawing Sheets

(51) Int. Cl.

| | |
|---|---|
| ***E21B 7/10*** | (2006.01) |
| ***E21B 7/06*** | (2006.01) |
| ***F04B 47/12*** | (2006.01) |
| ***E21B 43/38*** | (2006.01) |

(56) References Cited

U.S. PATENT DOCUMENTS 4,531,891 A * 7/1985 Coles, III ..... F04B 47/12 417/59
4,572,305 A * 2/1986 Swietlik ..... E21B 17/1078 175/321
5,131,479 A * 7/1992 Boulet ..... E21B 7/067 175/73
5,265,684 A * 11/1993 Rosenhauch ..... E21B 17/1078 175/325.2
6,045,335 A * 4/2000 Dinning ..... E21B 43/121 166/372
6,708,785 B1 * 3/2004 Russell ..... E21B 47/095 175/325.5
7,036,611 B2 * 5/2006 Radford ..... E21B 10/32 175/57
10,767,423 B2 * 9/2020 Al Ameri ..... E21B 17/1078
2001/0011591 A1 * 8/2001 Van-Drentham Susman ..... E21B 7/062 166/212
2002/0070052 A1 * 6/2002 Armell ..... E21B 10/322 175/273
2004/0084224 A1 * 5/2004 Lassoie ..... E21B 10/325 175/269

FOREIGN PATENT DOCUMENTS

CN 106677735 A 5/2017
CN 106837234 A 6/2017
CN 107313739 A 11/2017

* cited by examiner

FLUID SEPARATING DEVICE

CROSS-REFERENCE TO RELATED APPLICATION

This application is a national stage application of international application No. PCT/CN2018/104237, filed on Sep. 5, 2018, which claims priority to Chinese patent application No. 2017107942854, filed on Sep. 6, 2017, titled "Fluid separating device, wellhole structure and method for producing oil or natural gas," the disclosure of which are hereby incorporated by reference in their entirety.

FIELD OF THE INVENTION

The present invention relates to oil and natural gas exploitation, and more particularly to a fluid separating device, a wellhole structure and a method for producing oil or natural gas.

BACKGROUND OF THE INVENTION

In the process of developing oil or natural gas well, when the production of oil or natural gas in the well is low and the pressure in the well is insufficient, a large amount of fluid cannot be lifted to the surface, and this forms a certain height of liquid at the bottom of the well, which further reduces the productivity of the oil or natural gas well, and even causes the oil or natural gas well to stop production.

A fluid separating device is provided in a related technology known by the inventor. A plurality of separators are disposed on the outer peripheral surface of the fluid separating device, and these separators are always in contact with the inner wall of a wellhole under the action of the elastic pieces to form a seal. In this way the pressure generated by the oil or natural gas below the separating device drives the fluid separating device upward, and discharges the fluid accumulated above the fluid separating device when the fluid separating device ascends to the wellhead. The problem of this fluid separating device is that, because the separators are always in contact with the inner wall of the wellhole under the action of the elastic pieces, the fluid separating device cannot descend to the bottom of the well or descends slowly under the combined action of the friction between the separators and the inner wall of the wellhole and the pressure of the oil or natural gas below the fluid separating device.

SUMMARY OF THE INVENTION

An objective of the present disclosure is to overcome the shortcomings of the known technology, provide a fluid separating device, which can eliminate the friction between the separators and the inner wall of the wellhole when descending, and then can quickly descend to the bottom of the well.

The embodiments of the present invention are implemented by the following technology solutions:

A fluid separating device comprises: a cylinder; a plurality of separators disposed around the cylinder; a first elastic piece disposed between the separator and the cylinder, and applying an elastic force to the separator outward along the radial direction of the cylinder; a first guiding device, which is set through the cylinder axially and configured to reciprocate between an expanded position and a contracted position along the axial direction of the cylinder; and a second guiding device penetrating the cylinder, which is connected to the separator at one end, and slidably fits with the first guiding device at the other end via a fitting surface; wherein the fitting surface gradually extends radially inward relative to the cylinder in the direction from a contracted position to an expanded position; when the first guiding device moves to the contracted position, the second guiding device drives the separator to move radially inward relative to the cylinder; when the first guiding device moves to the expanded position, the first elastic piece drives the separator to move radially outward relative to the cylinder.

Further, the first guiding device comprises a mandrel extending along the axial direction of the cylinder, and a part of an outer peripheral surface between the two ends of the mandrel to constitute the fitting surface; the second guiding device comprises: a positioning cylinder which is connected to the separator and provided with a first abutting part; a positioning post which is through the cylinder, slidably fitting with the positioning cylinder at one end, and slidably fitting with the fitting surface at the other end; a second elastic piece which is connected to the cylinder, and applies the elastic force inward to the positioning post along the radial direction of the cylinder; a second abutting part is disposed at one end of the positioning post slidably fitting with the positioning cylinder; when the first guiding device moves to the contracted position, the second elastic piece causes the first abutting part and the second abutting part to abut against each other, and drives the separator to move radially inward relative to the cylinder; when the first guiding device moves to the expanded position, the first elastic piece drives the separator to move radially outward relative to the cylinder.

Further, a first stop groove is disposed at one end of the fitting surface; when the first guiding device is located in the expanded position, the end of the positioning post which is away from the separator is embedded in the first stop groove; a second stop groove is disposed at the other end of the fitting surface; when the first guiding device is located in the contracted position, the end of the positioning post which is away from the separator is embedded in the second stop groove.

Further, the first guiding device comprises the mandrel extending along the axial direction of the cylinder, and a guiding fork connected to the mandrel; the fitting surface is disposed on the guiding fork; a guiding hole is disposed at the end of the second guiding device which is away from the separator for the guiding fork to pass through; the inner surface of the guiding hole slidably fits with the fitting surface.

Further, a first chamber is disposed in the mandrel, a first long hole extending along the axial direction of the mandrel is disposed on the wall of the first chamber; the first long hole is configured to slidably fit with the end of the second guiding device which is away from the separator, for the end of the second guiding device which is away from the separator to enter or leave the first chamber.

Further, the first guiding device comprises the mandrel extending along the axial direction of the cylinder, a second chamber is disposed in the mandrel, a second long hole extending along the axial direction of the mandrel is disposed on the wall of the second chamber; the second guiding device comprises a connecting section and a guiding section; the connecting section is connected to the separator, the guiding section is connected to the connecting section, the guiding section passes through the second long hole and enters the second chamber; the fitting surface is disposed on the guiding section; the fitting surface slidably fits with the edge of one end of the second long hole.

Further, the second guiding device further comprises a transition section; the connecting section and the guiding section are connected by the transition section; the transition section gradually extends axially outward relative to the cylinder in the direction from the contracted position to the expanded position; a positioning protrusion is formed at a connection position between the guiding section and the transition section; a positioning hole is disposed on the wall of the second chamber; when the first guiding device is located in the contracted position, the positioning protrusion is embedded in the positioning hole.

Further, the second guiding device is formed by bending a metal strip; the second guiding device has elasticity at the bend.

Further, an opening connecting the second chamber and the outside environment is disposed at the lower end of the mandrel; a first through-hole is disposed on the cylinder, and a second through-hole is disposed on the wall of the second chamber; when the first guiding device is located in the contracted position, the first through-hole and the second through-hole communicate with each other so that the second chamber communicates with the outside environment through the first through-hole and the second through-hole.

Further, the outer peripheral surface of the mandrel is provided with an annular protrusion protruding radially outward; the annular protrusion slidably fits with the inner peripheral surface of the cylinder.

Further, a drain through-hole is disposed on the wall of the second chamber.

Further, the first guiding device is provided with a first positioning space and a second positioning space, and the cylinder is connected to a positioning block by an elastic recovering piece; or the cylinder is provided with the first positioning space and the second positioning space, and the first guiding device is connected to the positioning block by the elastic recovering piece; when the first guiding device is located in the expanded position, the positioning block is embedded in the first positioning space under the action of the elastic recovering piece; when the first guiding device is located in the contracted position, the positioning block is embedded in the second positioning space under the action of the elastic recovering piece.

The technology solutions of the present invention have at least the following advantages and benefits:

In operation of the fluid separating device provided by the embodiment of the present invention, when the fluid separating device ascends to the upper end of the wellhole, the first guiding device strikes an upper percussion device, so that the first guiding device moves from the expanded position to the contracted position. When the first guiding device is located in the contracted position, the separator is not in contact with the inner wall of the wellhole and forms an annular gap for fluid to pass through. In this way, the friction between the separators and the inner wall of the wellhole is eliminated, and the oil or natural gas below the fluid separating device can flow upward through the annular gap, reduces the downward resistance to the fluid separating device, so that the fluid separating device can also quickly descend back to the bottom of the well. Even when the well is not shut down, the fluid separating device can quickly descend back to the bottom of the well. At the same time, during the downward movement of the fluid separating device, the service life of the separator is greatly improved due to the elimination of the friction between the separator and the inner wall of the wellhole.

BRIEF DESCRIPTION OF THE DRAWINGS

In order to illustrate the technical solutions of the embodiments of the present invention more clearly, the drawings that need to be used in the embodiments are briefly introduced below. It should be understood that the following drawings only show certain embodiments of the present invention and should not be construed as limiting the scope of the present invention. For the technicians in this field, they can obtain other drawings according to these drawings without any creative labor.

DETAILED DESCRIPTION OF PREFERRED EMBODIMENTS

Figure 1:
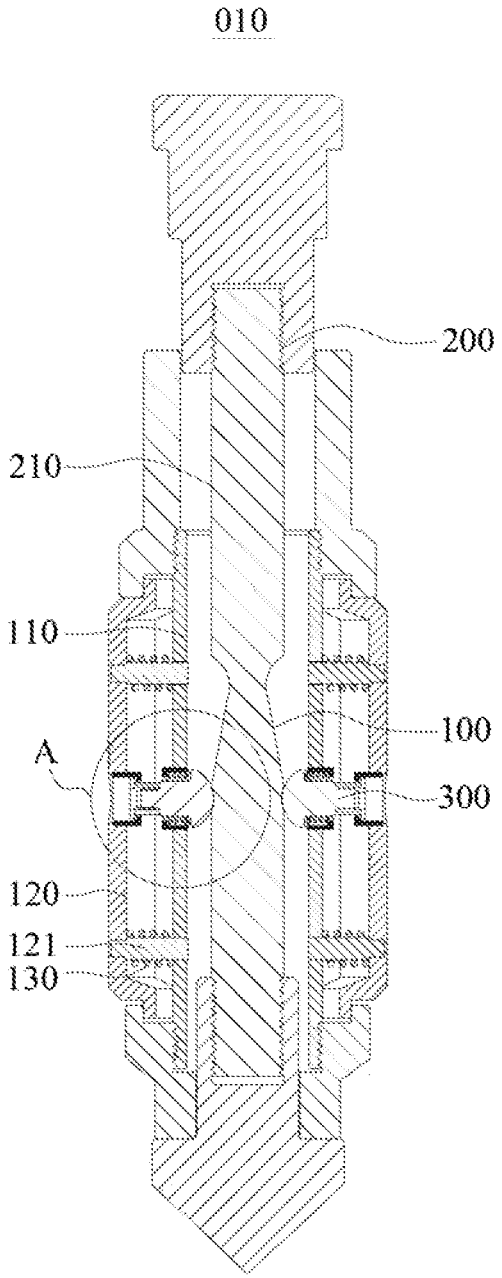
FIG. 1 is a cross-sectional view of a fluid separating device in an expanded state according to a first embodiment of the present disclosure.

In order to make the objectives, technical solutions and advantages of the embodiments in the present invention clearer, the technical solutions in the embodiments of the present invention will be clearly and completely described below with reference to the accompanying drawings. Obviously, the described embodiments are a part of embodiments of the present invention, but not all the embodiments.

Therefore, the following detailed description of the embodiments of the present invention is not intended to limit the protection scope of the claimed present invention, but only to show some of the embodiments of the present invention. Based on the embodiments of the present invention, all other embodiments obtained by the technicians in this field without any creative labor shall fall within protection scope of the claimed present invention.

It should be noted that, in the case of no conflict, the embodiments of the present invention, the characteristics and technical solutions of the embodiments can be combined with each other.

It should be noted that: similar reference numbers and letters indicate similar items in the following drawings, so there is no need to further define and explain it in subsequent drawings once an item is defined in one drawing.

In the description of the present invention, it should be noted that the orientations or positional relationships indicated by the terms "up" and "down" are based on the orientations or positional relationships shown in the drawings, or are commonly used when the products of the present invention are used, or are commonly understood by the technicians in this field, such terms are only for the convenience of describing the present invention and simplifying the description, rather than indicating or implying that the device or component referred to must have a specific orientation, or be configured and operate in a specific orientation, so that they cannot be understood as limitations to the present invention.

The terms "first", "second", etc, are only used to distinguish descriptions, and cannot be understood to indicate or imply relative importance.

Embodiment 1

Figure 2:
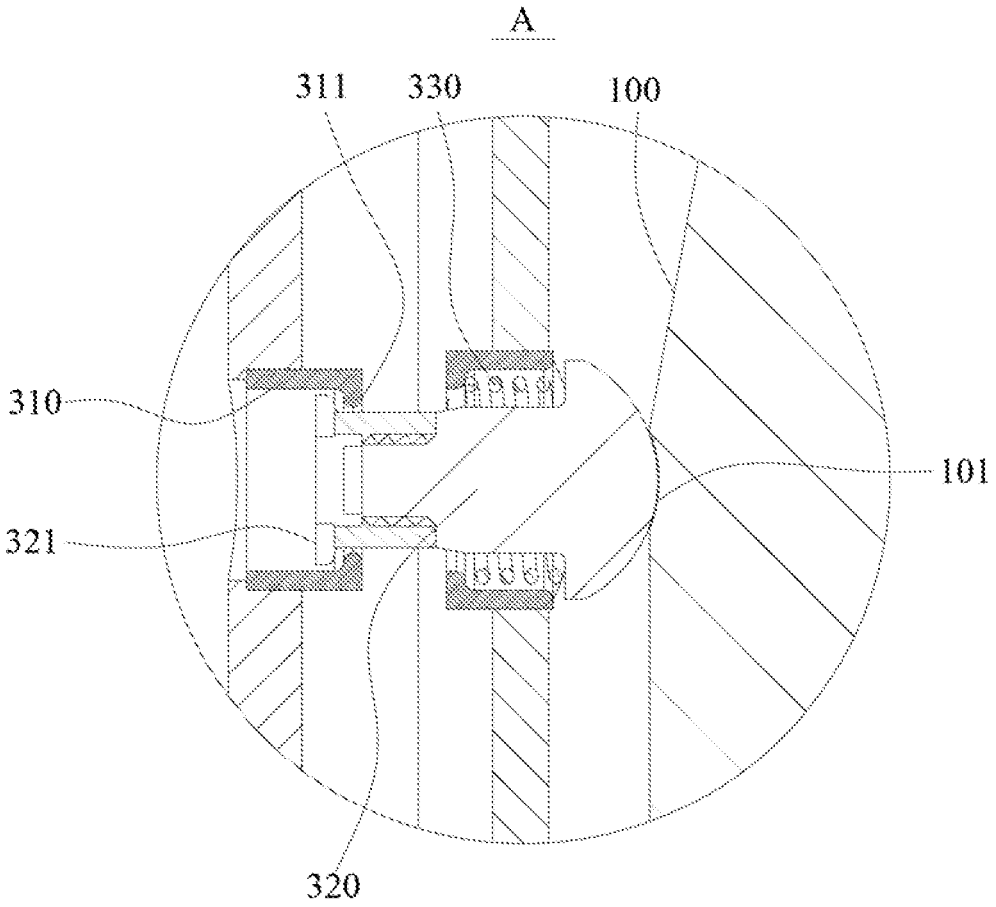
FIG. 2 is an enlarged view of circle A in FIG. 1.
Figure 3:
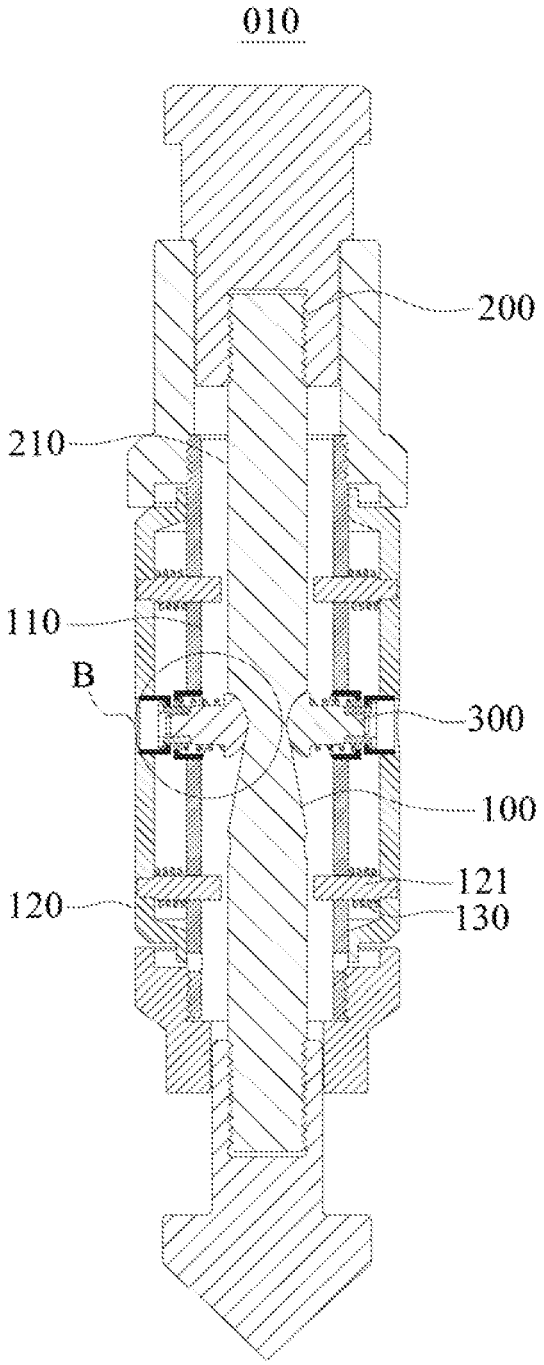
FIG. 3 is a cross-sectional view of the fluid separating device in a contracted state according to the first embodiment of the present disclosure.
Figure 4:
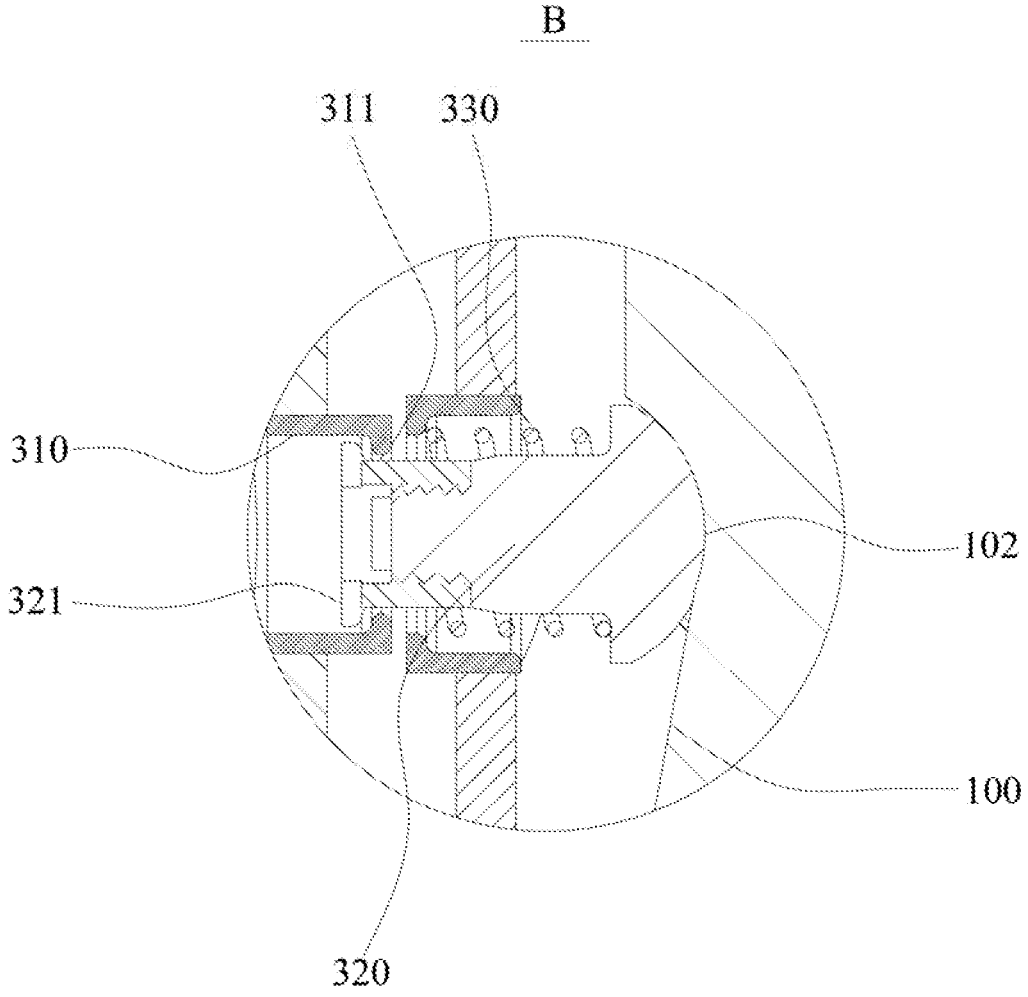
FIG. 4 is an enlarged view of circle B in FIG. 3.

Refer to FIG. 1 through FIG. 4. FIG. 1 is a cross-sectional view of a fluid separating device 010 in an expanded state according to this embodiment. FIG. 2 is an enlarged view of circle A in FIG. 1. FIG. 3 is a cross-sectional view of the fluid separating device 010 in a contracted state according to this embodiment. FIG. 4 is an enlarged view of circle B in FIG. 3.

In this embodiment, the fluid separating device 010 comprises a cylinder 110, a separator 120, a first elastic piece 130, a first guiding device 200 and a second guiding device 300. A plurality of separators 120 are disposed around the cylinder 110. The first elastic piece 130 is disposed between the separator 120 and the cylinder 110, the first elastic piece 130 applies a radially outward elastic force to the separator 120, so that the first separator 120 can move radially outward relative to the cylinder 110. The first guiding device 200 is set through in the cylinder 110 along the axial direction, and is configured to reciprocate between an expanded position (as shown in FIG. 1) and a contracted position (as shown in FIG. 3) along the axial direction of the cylinder 110. The second guiding device 300 penetrates the cylinder 110, one end is connected to the separator 120, and the other end slidably fits with the first guiding device 200 via a fitting surface 100. The fitting surface 100 gradually extends radially inward relative to the cylinder 110 in the direction from the contracted position to the expanded position. When the first guiding device 200 moves to the contracted position, the second guiding device 300 drives the separator 120 to move radially inward relative to the cylinder 110; when the first guiding device 200 moves to the expanded position, the first elastic piece 130 drives the separator 120 to move radially outward relative to the cylinder 110.

Specifically, in this embodiment, the first guiding device 200 comprises a mandrel 210 extending along the axial direction of the cylinder 110, the fitting surface 100 configured by a part of outer peripheral surface between the two ends of the mandrel 210.

The second guiding device 300 comprises a positioning cylinder 310, a positioning post 320 and a second elastic piece 330. One end of the positioning cylinder 310 is connected to the separator 120, and the other end of the positioning cylinder 310 is provided with a first abutting part 311 extending radially inward. The positioning post 320 penetrates the cylinder 110. One end of the positioning post 320 extends into the positioning cylinder 310 and slidably fits with the positioning cylinder 310, the end of the positioning post 320 located in the positioning cylinder 310 is provided with a second abutting part 321 protruding radially outward. The other end of the positioning post 320 is hemispherical and slidably fits with the fitting surface 100 during the movement of the mandrel 210. The second elastic piece 330 is sleeved on the positioning post 320, one end of the second elastic piece 330 is connected to the cylinder 110, the other end is connected to the positioning post 320. The second elastic piece 330 applies an elastic force to the positioning post 320 inward along the radial direction of the cylinder 110. When the first guiding device 200 moves to the contracted position, the second elastic piece 330 causes the first abutting part 311 and the second abutting part 321 to abut against each other, and drives the separator 120 to move radially inward relative to the cylinder 110; when the first guiding device 200 moves to the expanded position, the first elastic piece 130 drives the separator 120 to move radially outward relative to the cylinder 110.

Figure 5:
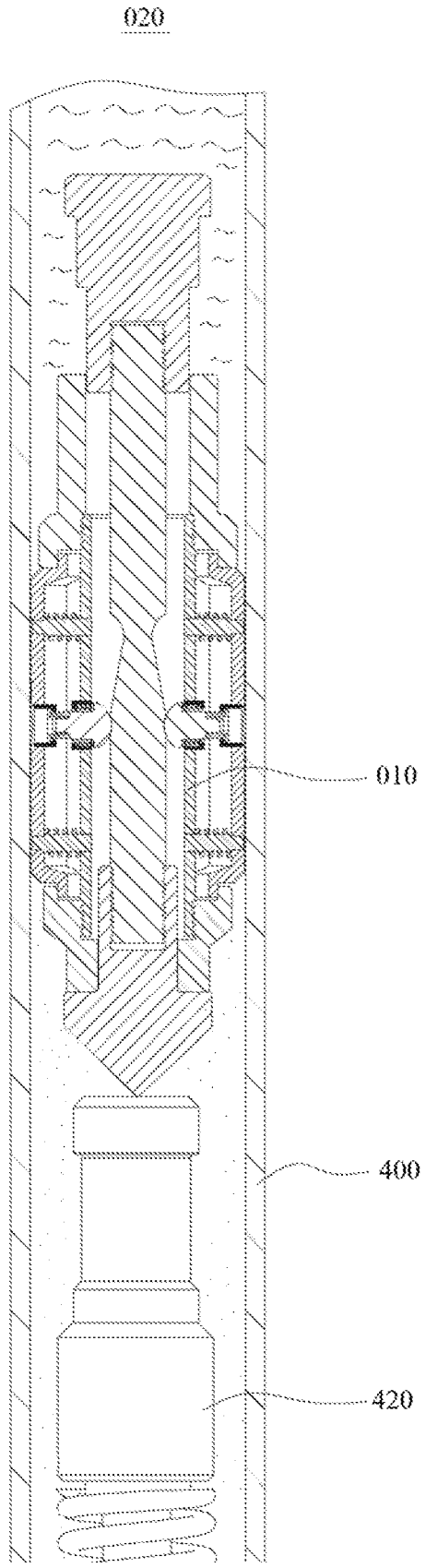
FIG. 5 is a cross-sectional view of a wellhole structure according to the first embodiment of the present disclosure.
Figure 6:
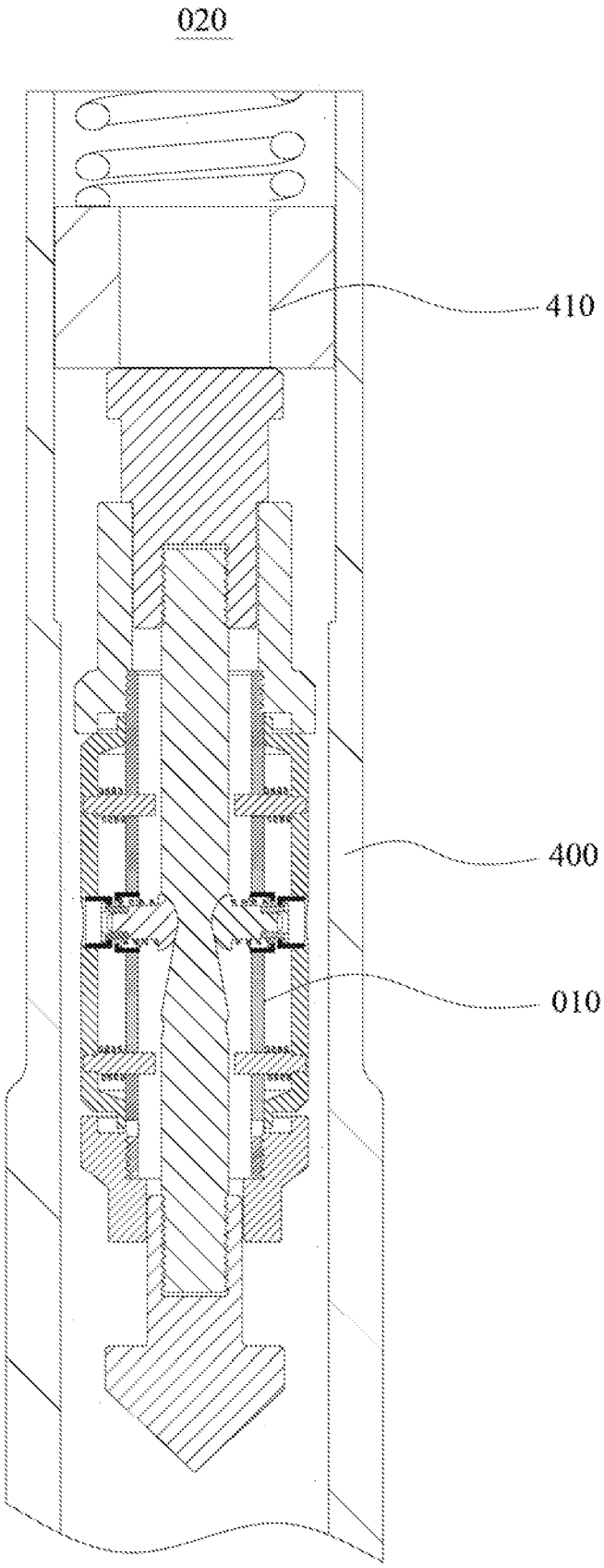
FIG. 6 is another cross-sectional view of the wellhole structure according to the first embodiment of the present disclosure.

Refer to FIG. 5 and FIG. 6, the embodiment further provides a wellhole structure 020. The wellhole structure 020 comprises a wellhole 400 and the fluid separating device 010 described above. The upper end of the wellhole 400 is provided with an upper percussion device 410, the lower end of the wellhole 400 is provided with a lower percussion device 420. FIG. 5 is a cross-sectional view of the fluid separating device 010 moving to the lower end of the wellhole 400 and the first guiding device 200 striking the lower percussion device 420, at this time, the first guiding device 200 is located in the expanded position, and the fluid separating device 010 is in the expanded state. FIG. 6 is a cross-sectional view of the fluid separating device 010 moving to the upper end of the wellhole 400 and the first guiding device 200 striking the upper percussion device 410, at this time, the first guiding device 200 is located in the contracted position and the fluid separating device 010 is in the contracted state.

Refer to FIG. 5, when the fluid separating device 010 moves to the lower end of the wellhole 400 and the first guiding device 200 strikes the lower percussion device 420, the first guiding device 200 moves to the expanded position, the positioning post 320 moves radially outward under the action of the fitting surface 100, the second elastic piece 330 is compressed, and the first abutting part 311 and the second abutting part 321 are separated from each other. Then, the first elastic piece 130 drives the separator 120 to move radially outward, so that the separator 120 is in contact with the inner wall of the wellhole 400. At this time, it is difficult for the oil or natural gas below the fluid separating device 010 to flow above the fluid separating device 010, so the pressure of the oil or natural gas below the fluid separating device 010 increases, which in turn drives the fluid separating device 010 upward. During the upward movement of the fluid separating device 010, the liquid accumulated above the fluid separating device 010 is lifted upward and discharged through the wellhead. When the fluid separating device 010 moves to the upper end of the wellhole 400 and the first guiding device 200 strikes the upper percussion device 410, the first guiding device 200 moves to the contracted position. Since the elastic force of the second elastic piece 330 is greater than the elastic force of the first elastic piece 130, the second elastic piece 330 causes the first abutting part 311 and the second abutting part 321 to abut against each other, drives the separator 120 to move radially inward relative to the cylinder 110, and causes the separator 120 to separate from the inner wall of the wellhole 400, thereby forming an annular gap between the fluid separating device 010 and the wellhole 400. In this way, the friction between the separator 120 and the inner wall of the wellhole 400 is eliminated, and the oil or natural gas below the fluid separating device 010 can flow upward through the annular gap, which reduces the downward resistance to the fluid separating device 010, and enables the fluid separating device 010 to quickly return to the bottom of the well. Even when the well is not shut down, the fluid separating device 010 can quickly descend back to the bottom of the well. At the same time, during the downward movement of the fluid separating device 010, since the friction between the separator 120 and the inner wall of the wellhole 400 is eliminated, the service life of the separator 120 is greatly improved.

Refer to FIG. 1 and FIG. 3, further, in order to stably lift the accumulated liquid during the upward movement of the fluid separating device 010, the first guiding device 200 needs to be maintained in the expanded position during the upward movement. For this reason, in this embodiment, a first stop groove 101 is disposed at one end of the fitting surface 100; when the first guiding device 200 is located in the expanded position, the end of the positioning post 320 which is away from the separator 120 is embedded in the first stop groove 101 to maintain the first guiding device 200 in the expanded position. Only when the first guiding device 200 receives a downward impact force, the end of the positioning post 320 which is away from the separator 120 can be released from the first stop groove 101. In this way, it ensures that the first guiding device 200 is always maintained in the expanded position during the upward movement.

Refer to FIG. 1 and FIG. 3, further, in order to enable the fluid separating device 010 to descend quickly, the first guiding device 200 needs to be maintained in the contracted position during the downward movement. For this reason, in this embodiment, a second stop groove 102 is disposed at the other end of the fitting surface 100; when the first guiding device 200 is located in the contracted position, the end of the positioning post 320 which is away from the separator 120 is embedded in the second stop groove 102 to maintain the first guiding device 200 in the contracted position. Only when the first guiding device 200 receives an upward impact force, the end of the positioning post 320 which is away from the separator 120 can be released from the second stop groove 102. In this way, it ensures that the first guiding device 200 is always maintained in the contracted position during the downward movement.

Refer to FIG. 1 and FIG. 3, further, in order to ensure that the separator 120 can achieve stable and reliable radial movement, in this embodiment, a guiding post 121 is further provided. The guiding post 121 extends along the radial direction of the cylinder 110. One end of the guiding post 121 is connected to the separator 120, and the other end of the guiding post 121 slidably penetrates the cylinder 110. During the movement, the guiding post 121 guides the separator 120 to ensure that the separator 120 can achieve stable and reliable radial movement. In this embodiment, the first elastic piece 130 is sleeved on the guiding post 121.

Embodiment 2

Figure 7:
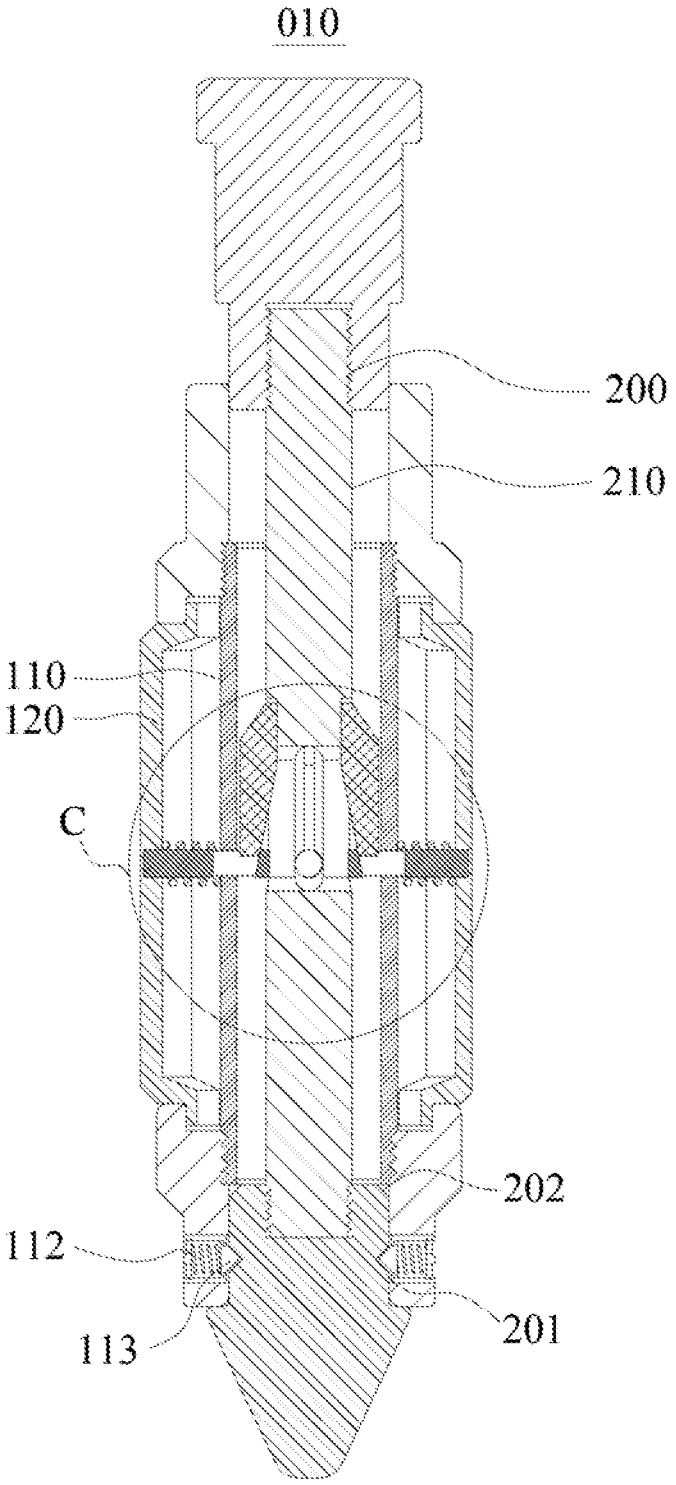
FIG. 7 is a cross-sectional view of a fluid separating device in an expanded state according to a second embodiment of the present disclosure.
Figure 8:
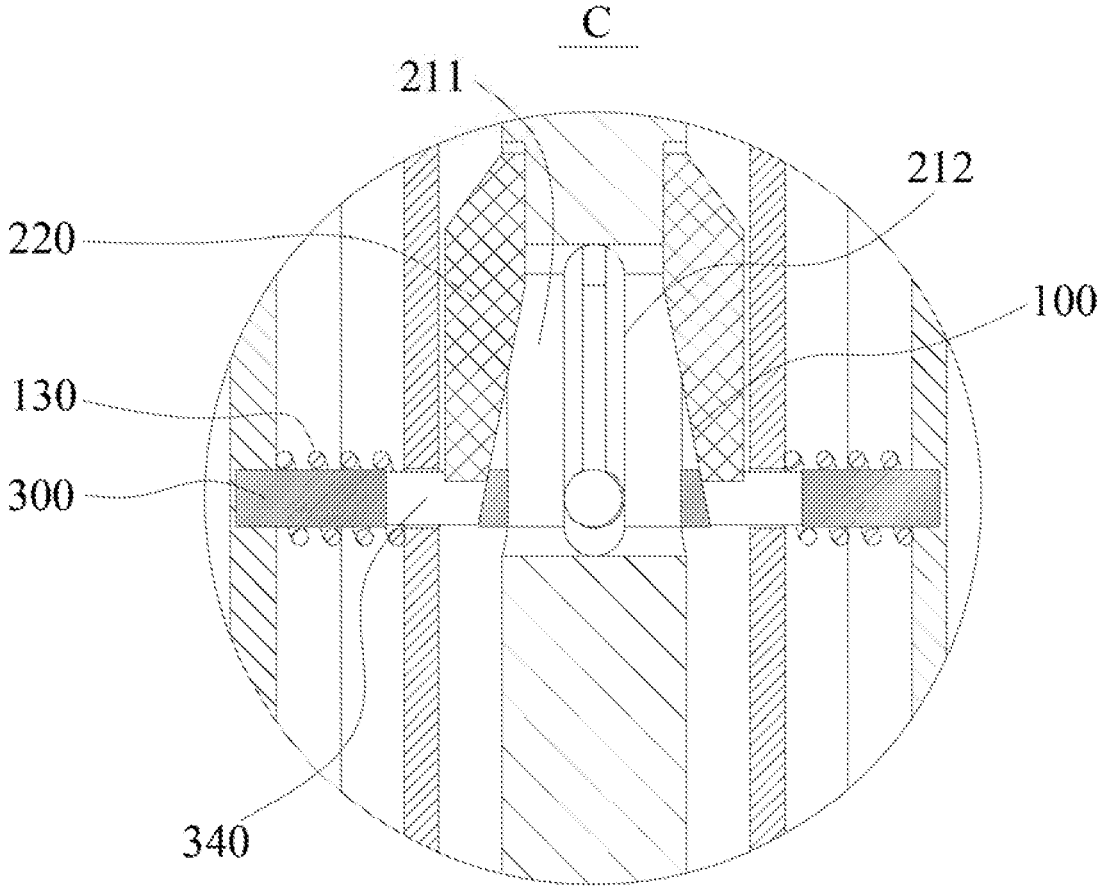
FIG. 8 is an enlarged view of circle C in FIG. 7.
Figure 9:
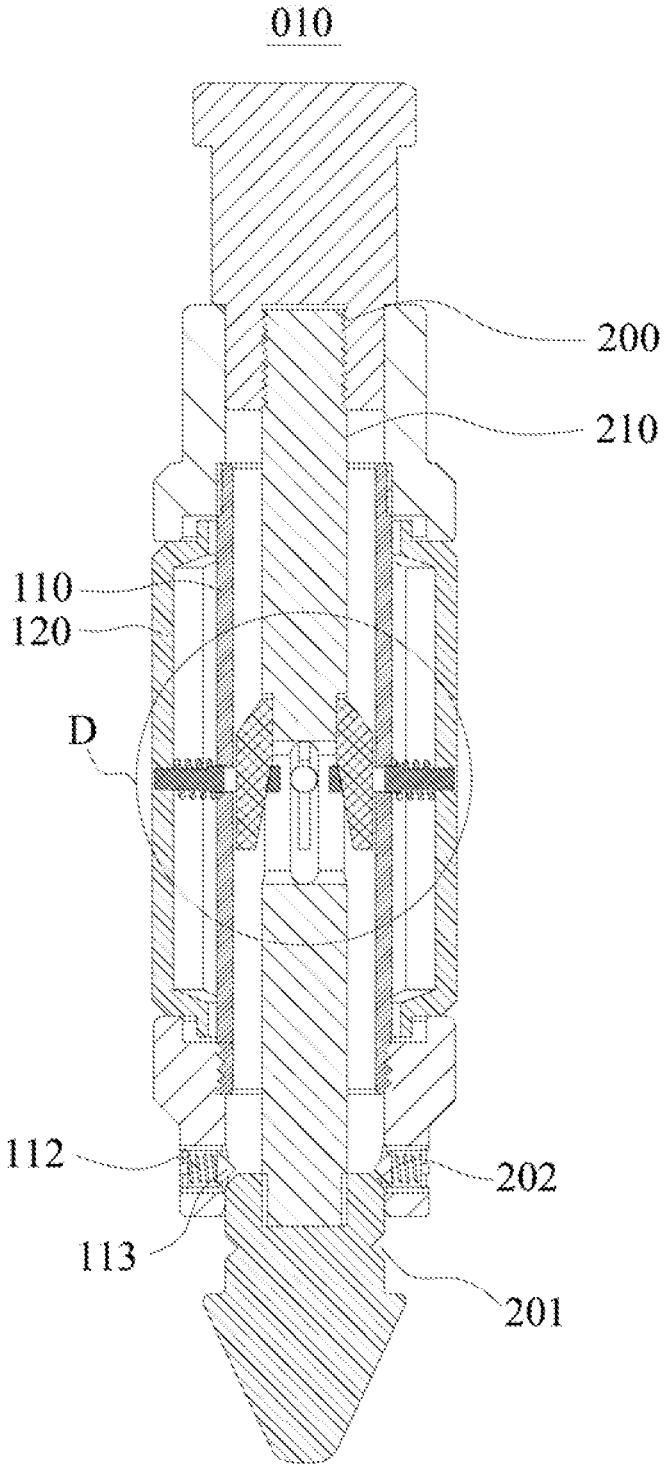
FIG. 9 is a cross-sectional view of the fluid separating device in a contracted state according to the second embodiment of the present disclosure.
Figure 10:
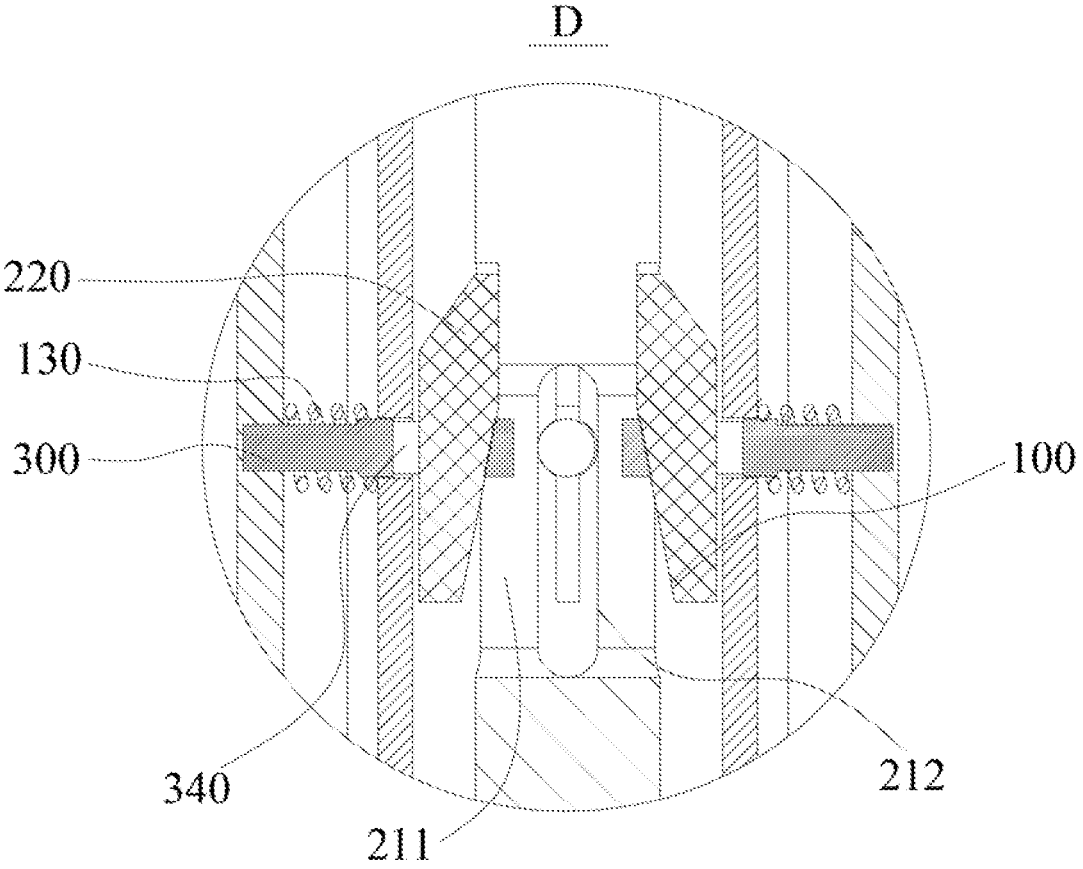
FIG. 10 is an enlarged view of circle D in FIG. 9.

Refer to FIG. 7 through FIG. 10. FIG. 7 is a cross-sectional view of a fluid separating device 010 in an expanded state according to this embodiment. FIG. 8 is an enlarged view of circle C in FIG. 7. FIG. 9 is a cross-sectional view of the fluid separating device 010 in a contracted state according to this embodiment. FIG. 10 is an enlarged view of circle D in FIG. 9.

In this embodiment, the fluid separating device 010 comprises a cylinder 110, a separator 120, a first elastic piece 130, a first guiding device 200 and a second guiding device 300. A plurality of separators 120 are disposed around the cylinder 110. The first elastic piece 130 is disposed between the separator 120 and the cylinder 110, the first elastic piece 130 applies a radially outward elastic force to the separator 120, so that the first separator 120 can move radially outward relative to the cylinder 110. The first guiding device 200 is set through in the cylinder 110 along the axial direction, and is configured to reciprocate between an expanded position (as shown in FIG. 7) and a contracted position (as shown in FIG. 9) along the axial direction of the cylinder 110. The second guiding device 300 penetrates the cylinder 110, one end is connected to the separator 120, and the other end slidably fits with the first guiding device 200 via a fitting surface 100. The fitting surface 100 gradually extends radially inward relative to the cylinder 110 in the direction from the contracted position to the expanded position. When the first guiding device 200 moves to the contracted position, the second guiding device 300 drives the separator 120 to move radially inward relative to the cylinder 110; when the first guiding device 200 moves to the expanded position, the first elastic piece 130 drives the separator 120 to move radially outward relative to the cylinder 110.

Specifically, in this embodiment, the first guiding device 200 comprises a mandrel 210 extending along the axial direction of the cylinder 110, and a guiding fork 220 connected to the mandrel 210; the fitting surface 100 is set on the guiding fork 220. The second guiding device 300 is columnar. A guiding hole 340 is disposed at the end of the second guiding device 300 which is away from the separator 120 for the guiding fork 220 to pass through. The inner surface of the guiding hole 340 slidably fits with the fitting surface 100. The first elastic piece 130 is sleeved on the second guiding device 300. When the first guiding device 200 moves to the contracted position, with the cooperation of the fitting surface 100 on the guiding fork 220 and the guiding hole 340, the second guiding device 300 drives the separator 120 to move radially inward. When the first guiding device 200 moves to the expanded position, the first elastic piece 130 drives the separator 120 to move radially outward relative to the cylinder 110.

Figure 11:
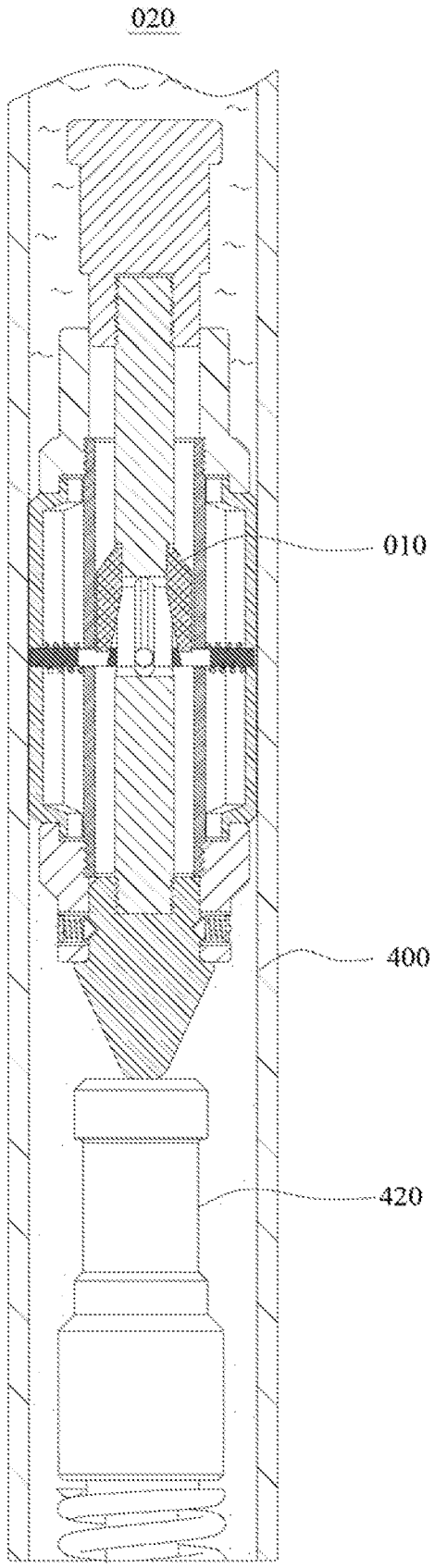
FIG. 11 is a cross-sectional view of a wellhole structure according to the second embodiment of the present disclosure.
Figure 12:
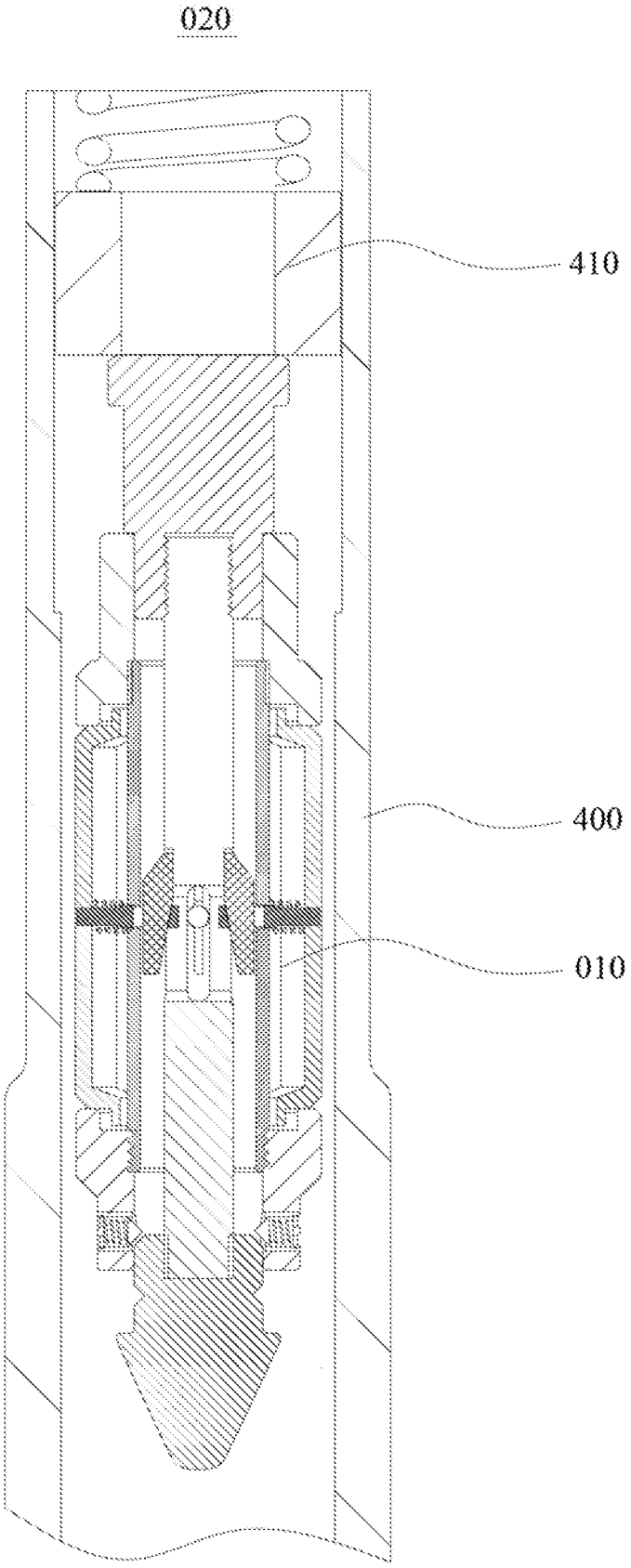
FIG. 12 is another cross-sectional view of the wellhole structure according to the second embodiment of the present disclosure.

Refer to FIG. 11 and FIG. 12, this embodiment further provides a wellhole structure 020. The wellhole structure 020 comprises a wellhole 400 and the fluid separating device 010 described above. The upper end of the wellhole 400 is provided with an upper percussion device 410, the lower end of the wellhole 400 is provided with a lower percussion device 420. FIG. 11 is a cross-sectional view of the fluid separating device 010 moving to the lower end of the wellhole 400 and the first guiding device 200 striking the lower percussion device 420, at this time, the first guiding device 200 is located in the expanded position, and the fluid separating device 010 is in the expanded state. FIG. 12 is a cross-sectional view of the fluid separating device 010 moving to the upper end of the wellhole 400 and the first guiding device 200 striking the upper percussion device 410, at this time, the first guiding device 200 is located in the contracted position and the fluid separating device 010 is in the contracted state.

Refer to FIG. 11, when the fluid separating device 010 moves to the lower end of the wellhole 400 and the first guiding device 200 strikes the lower percussion device 420, the first guiding device 200 moves to the expanded position, the first elastic piece 130 drives the separator 120 to move radially outward relative to the cylinder 110, so that the separator 120 is in contact with the inner wall of the wellhole 400. At this time, it is difficult for the oil or natural gas below the fluid separating device 010 to flow above the fluid separating device 010, so the pressure of the oil or natural gas below the fluid separating device 010 increases, which in turn drives the fluid separating device 010 upward. During the upward movement of the fluid separating device 010, the liquid accumulated above the fluid separating device 010 is lifted upward and discharged through the wellhead. When the fluid separating device 010 moves to the upper end of the wellhole 400 and the first guiding device 200 strikes the upper percussion device 410, the first guiding device 200 moves to the contracted position. With the cooperation of the fitting surface 100 on the guiding fork 220 and the guiding hole 340, the second guiding device 300 drives the separator 120 to move radially inward, and causes the separator 120 to separate from the inner wall of the wellhole 400, thereby forming an annular gap between the fluid separating device 010 and the wellhole 400. In this way, the friction between the separator 120 and the inner wall of the wellhole 400 is eliminated, and the oil or natural gas below the fluid separating device 010 can flow upward through the annular gap, which reduces the downward resistance to the fluid separating device 010, and enables the fluid separating device 010 to quickly return to the bottom of the well. Even when the well is not shut down, the fluid separating device 010 can quickly descend back to the bottom of the well. At the same time, during the downward movement of the fluid separating device 010, since the friction between the separator 120 and the inner wall of the wellhole 400 is eliminated, the service life of the separator 120 is greatly improved.

Refer to FIG. 8 and FIG. 10, in this embodiment, in order to make the structure of the fluid separating device 010 more compact, a first chamber 211 is disposed in the mandrel 210, a first long hole 212 extending along the axial direction of the mandrel 210 is disposed on the wall of the first chamber 211; the first long hole 212 is configured to slidably fits with the end of the second guiding device 300 which is away from the separator 120, for the end of the second guiding device 300 which is away from the separator 120 to enter or leave the first chamber 211. Since the second guiding device 300 can enter the first chamber 211 during work, the structure of the fluid separating device 010 is more compact.

Refer to FIG. 7 and FIG. 9, further, in order to stably lift the accumulated liquid during the upward movement of the fluid separating device 010, the first guiding device 200 needs to be maintained in the expanded position during the upward movement, and in order to enable the fluid separating device 010 to descend quickly, the first guiding device 200 needs to be maintained in the contracted position during the downward movement. For this reason, in this embodiment, the lower end of the mandrel 210 is provided with a first positioning space 201 and a second positioning space 202 spaced out along the axial direction. The cylinder 110 is connected to a positioning block 113 by an elastic recovering piece 112; when the first guiding device 200 is located in the expanded position, the positioning block 113 is embedded in the first positioning space 201 under the action of the elastic recovering piece 112, so that the first guiding device 200 is maintained in the expanded position. Only when the first guiding device 200 receives a downward impact force, the positioning block 113 can be released from the first positioning space 201. In this way, it ensures that the first guiding device 200 is always maintained in the expanded position during the upward movement. When the first guiding device 200 is located in the contracted position, the positioning block 113 is embedded in the second positioning space 202 under the action of the elastic recovering piece 112 to maintain the first guiding device in the contracted position. Only when the first guiding device 200 receives an upward impact force, the positioning block 113 can be released from the second positioning space 202. In this way, it ensures that the first guiding device 200 is always maintained in the contracted position during the downward movement.

It can be understood that, in other embodiments, the first positioning space 201 and the second positioning space 202 may be disposed on the cylinder 110, and the first guiding device 200 is connected to the positioning block 113 by the elastic recovering piece 112.

Embodiment 3

Figure 13:
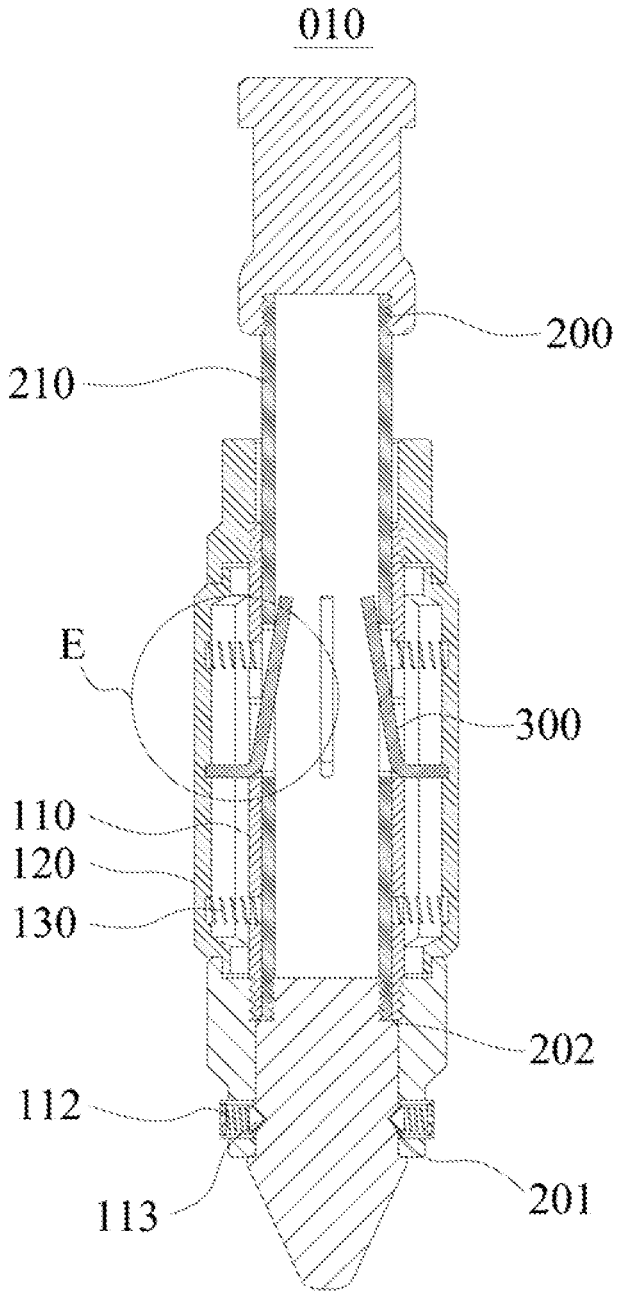
FIG. 13 is a cross-sectional view of a fluid separating device in an expanded state according to a third embodiment of the present disclosure.
Figure 14:
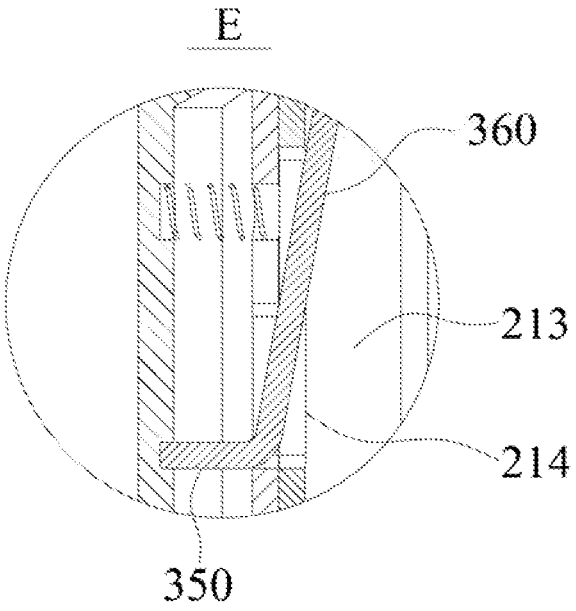
FIG. 14 is an enlarged view of circle E in FIG. 13.
Figure 15:
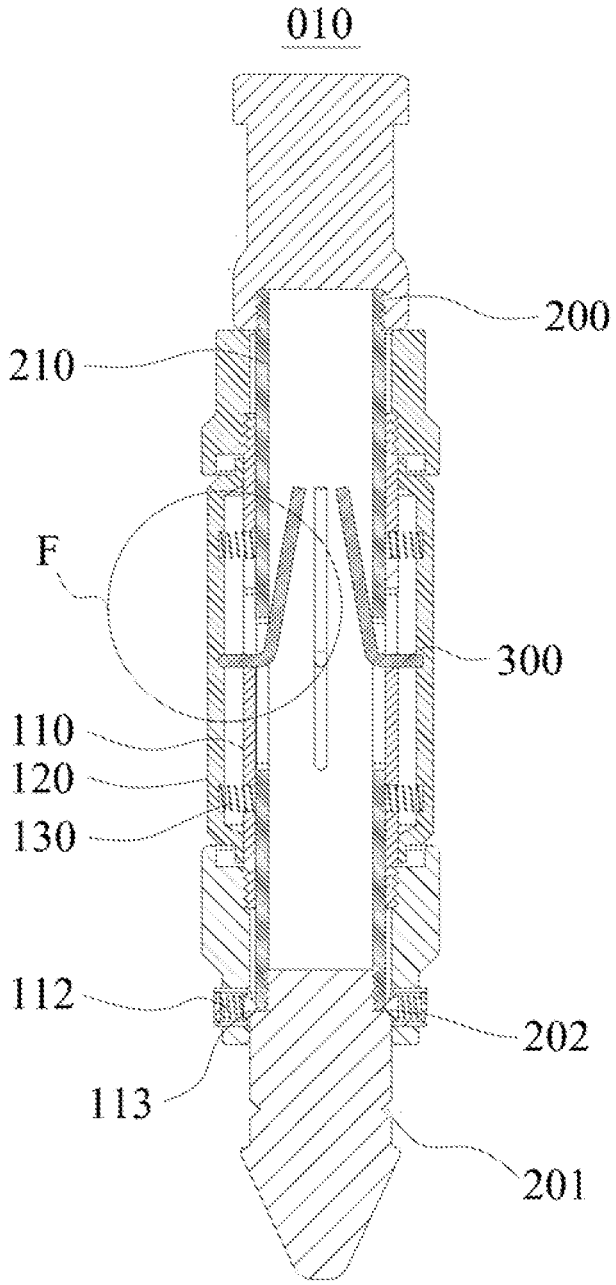
FIG. 15 is a cross-sectional view of the fluid separating device in a contracted state according to the third embodiment of the present disclosure.
Figure 16:
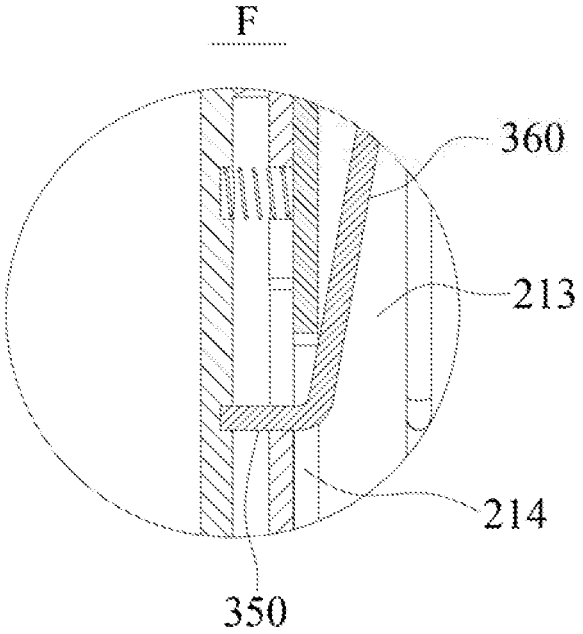
FIG. 16 is an enlarged view of circle F in FIG. 15.

Refer to FIG. 13 through FIG. 16. FIG. 13 is a cross-sectional view of a fluid separating device 010 in an expanded state according to this embodiment. FIG. 14 is an enlarged view of circle E in FIG. 13. FIG. 15 is a cross-sectional view of the fluid separating device 010 in a contracted state according to this embodiment. FIG. 16 is an enlarged view of circle F in FIG. 15.

In this embodiment, the fluid separating device 010 comprises a cylinder 110, a separator 120, a first elastic piece 130, a first guiding device 200 and a second guiding device 300. A plurality of separators 120 are disposed around the cylinder 110. The first elastic piece 130 is disposed between the separator 120 and the cylinder 110, the first elastic piece 130 applies a radially outward elastic force to the separator 120, so that the first separator 120 can move radially outward relative to the cylinder 110. The first guiding device 200 is set through in the cylinder 110 along the axial direction, and is configured to reciprocate between an expanded position (as shown in FIG. 13) and a contracted position (as shown in FIG. 15) along the axial direction of the cylinder 110. The second guiding device 300 penetrates the cylinder 110, one end is connected to the separator 120, and the other end slidably fits with the first guiding device 200 via a fitting surface 100. The fitting surface 100 gradually extends radially inward relative to the cylinder 110 in the direction from the contracted position to the expanded position. When the first guiding device 200 moves to the contracted position, the second guiding device 300 drives the separator 120 to move radially inward relative to the cylinder 110; when the first guiding device 200 moves to the expanded position, the first elastic piece 130 drives the separator 120 to move radially outward relative to the cylinder 110.

Specifically, in this embodiment, the first guiding device 200 comprises a mandrel 210 extending along the axial direction of the cylinder 110, a second chamber 213 is disposed in the mandrel 210, a second long hole 214 extending along the axial direction of the mandrel 210 is disposed on the wall of the second chamber 213. The second guiding device 300 comprises a connecting section 350 and a guiding section 360; the connecting section 350 is connected to the separator 120, the guiding section 360 is connected to the connecting section 350; the guiding section 360 passes through the second long hole 214 and enters the second chamber 213; the fitting surface 100 is disposed on the guiding section 360; the fitting surface 100 slidably fits with the edge of one end of the second long hole 214. When the first guiding device 200 moves to the contracted position, under the action of the fitting surface 100 on the guiding section 360, the second guiding device 300 drives the separator 120 to move radially inward. When the first guiding device 200 moves to the expanded position, the first elastic piece 130 drives the separator 120 to move radially outward relative to the cylinder 110.

Figure 17:
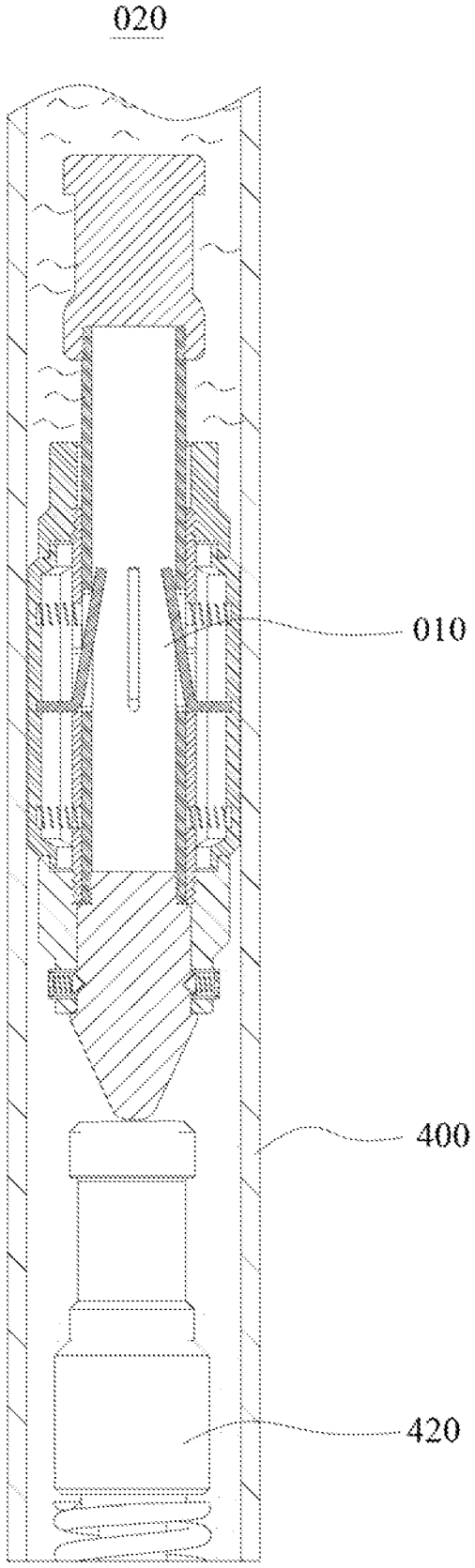
FIG. 17 is a cross-sectional view of a wellhole structure according to the third embodiment of the present disclosure.
Figure 18:
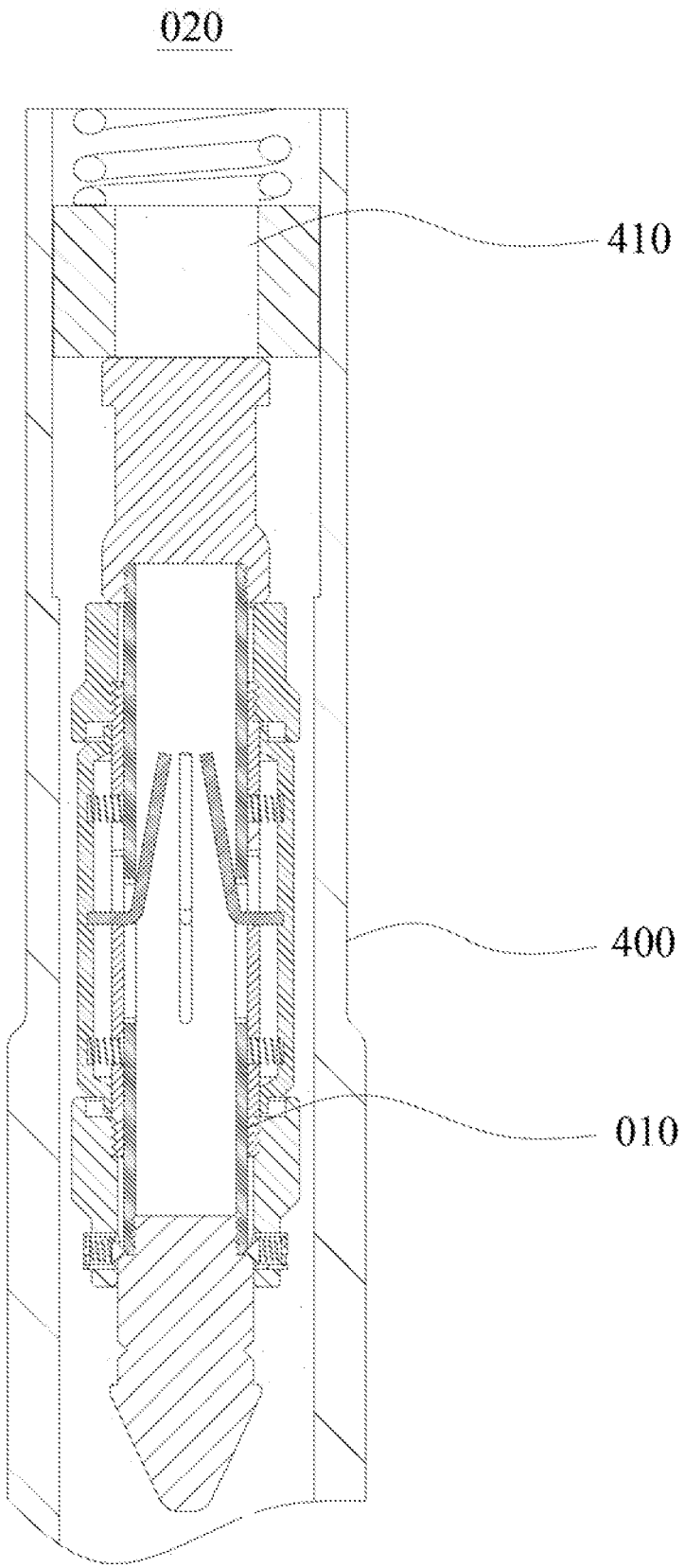
FIG. 18 is another cross-sectional view of the wellhole structure according to the third embodiment of the present disclosure.

Refer to FIG. 17 and FIG. 18, this embodiment further provides a wellhole structure 020. The wellhole structure 020 comprises a wellhole 400 and the fluid separating device 010 described above. The upper end of the wellhole 400 is provided with an upper percussion device 410, the lower end of the wellhole 400 is provided with a lower percussion device 420. FIG. 17 is a cross-sectional view of the fluid separating device 010 moving to the lower end of the wellhole 400 and the first guiding device 200 striking the lower percussion device 420, at this time, the first guiding device 200 is located in the expanded position, and the fluid separating device 010 is in the expanded state. FIG. 18 is a cross-sectional view of the fluid separating device 010 moving to the upper end of the wellhole 400 and the first guiding device 200 striking the upper percussion device 410, at this time, the first guiding device 200 is located in the contracted position and the fluid separating device 010 is in the contracted state.

Refer to FIG. 17, when the fluid separating device 010 moves to the lower end of the wellhole 400 and the first guiding device 200 strikes the lower percussion device 420, the first guiding device 200 moves to the expanded position, the first elastic piece 130 drives the separator 120 to move radially outward relative to the cylinder 110, so that the separator 120 is in contact with the inner wall of the wellhole 400. At this time, it is difficult for the oil or natural gas below the fluid separating device 010 to flow above the fluid separating device 010, so the pressure of the oil or natural gas below the fluid separating device 010 increases, which in turn drives the fluid separating device 010 upward. During the upward movement of the fluid separating device 010, the liquid accumulated above the fluid separating device 010 is lifted upward and discharged through the wellhead. When the fluid separating device 010 moves to the upper end of the wellhole 400 and the first guiding device 200 strikes the upper percussion device 410, the first guiding device 200 moves to the contracted position. Under the action of the fitting surface 100 on the guiding section 360, the second guiding device 300 drives the separator 120 to move radially inward, and causes the separator 120 to separate from the inner wall of the wellhole 400, thereby forming an annular gap between the fluid separating device 010 and the wellhole 400. In this way, the friction between the separator 120 and the inner wall of the wellhole 400 is eliminated, and the oil or natural gas below the fluid separating device 010 can flow upward through the annular gap, which reduces the downward resistance to the fluid separating device 010, and enables the fluid separating device 010 to quickly return to the bottom of the well. Even when the well is not shut down, the fluid separating device 010 can quickly descend back to the bottom of the well. At the same time, during the downward movement of the fluid separating device 010, since the friction between the separator 120 and the inner wall of the wellhole 400 is eliminated, the service life of the separator 120 is greatly improved.

Refer to FIG. 13 and FIG. 15, further, in order to stably lift the accumulated liquid during the upward movement of the fluid separating device 010, the first guiding device 200 needs to be maintained in the expanded position during the upward movement, and in order to enable the fluid separating device 010 to descend quickly, the first guiding device 200 needs to be maintained in the contracted position during the downward movement. For this reason, in this embodiment, the lower end of the mandrel 210 is provided with a first positioning space 201 and a second positioning space 202 spaced out along the axial direction. The cylinder 110 is connected to a positioning block 113 by an elastic recovering piece 112; when the first guiding device 200 is located in the expanded position, the positioning block 113 is embedded in the first positioning space 201 under the action of the elastic recovering piece 112, so that the first guiding device 200 is maintained in the expanded position. Only when the first guiding device 200 receives a downward impact force, the positioning block 113 can be released from the first positioning space 201. In this way, it ensures that the first guiding device 200 is always maintained in the expanded position during the upward movement. When the first guiding device 200 is located in the contracted position, the positioning block 113 is embedded in the second positioning space 202 under the action of the elastic recovering piece 112 to maintain the first guiding device 200 in the contracted position. Only when the first guiding device 200 receives an upward impact force, the positioning block 113 can be released from the second positioning space 202. In this way, it ensures that the first guiding device 200 is always maintained in the contracted position during the downward movement.

It can be understood that, in other embodiments, the first positioning space 201 and the second positioning space 202 may be disposed on the cylinder 110, and the first guiding device 200 is connected to the positioning block 113 by the elastic recovering piece 112.

Embodiment 4

Figure 19:
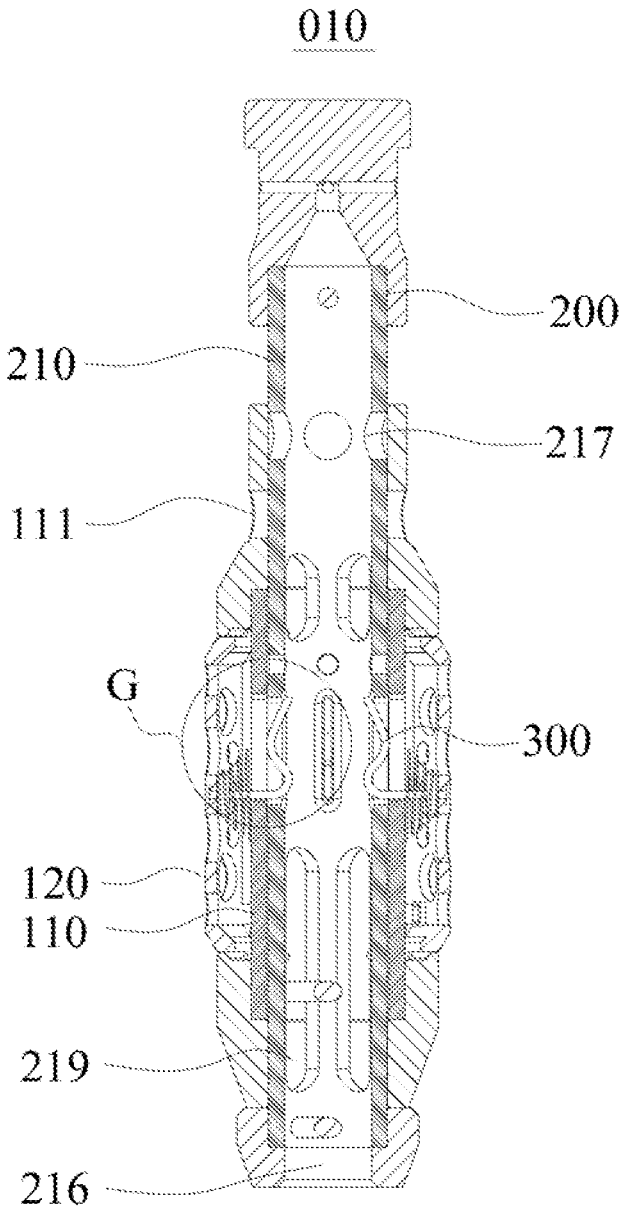
FIG. 19 is a cross-sectional view of a fluid separating device in an expanded state according to a fourth embodiment of the present disclosure.
Figure 20:
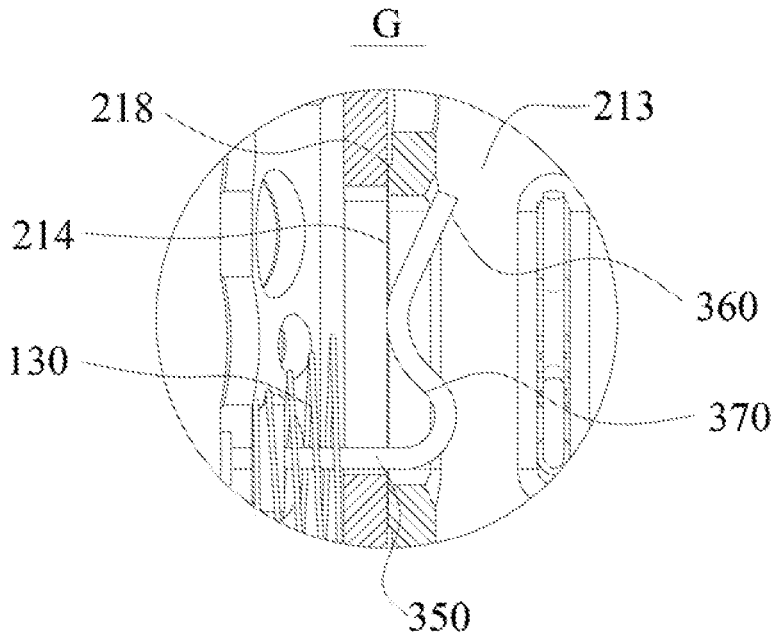
FIG. 20 is an enlarged view of circle G in FIG. 19.
Figure 21:
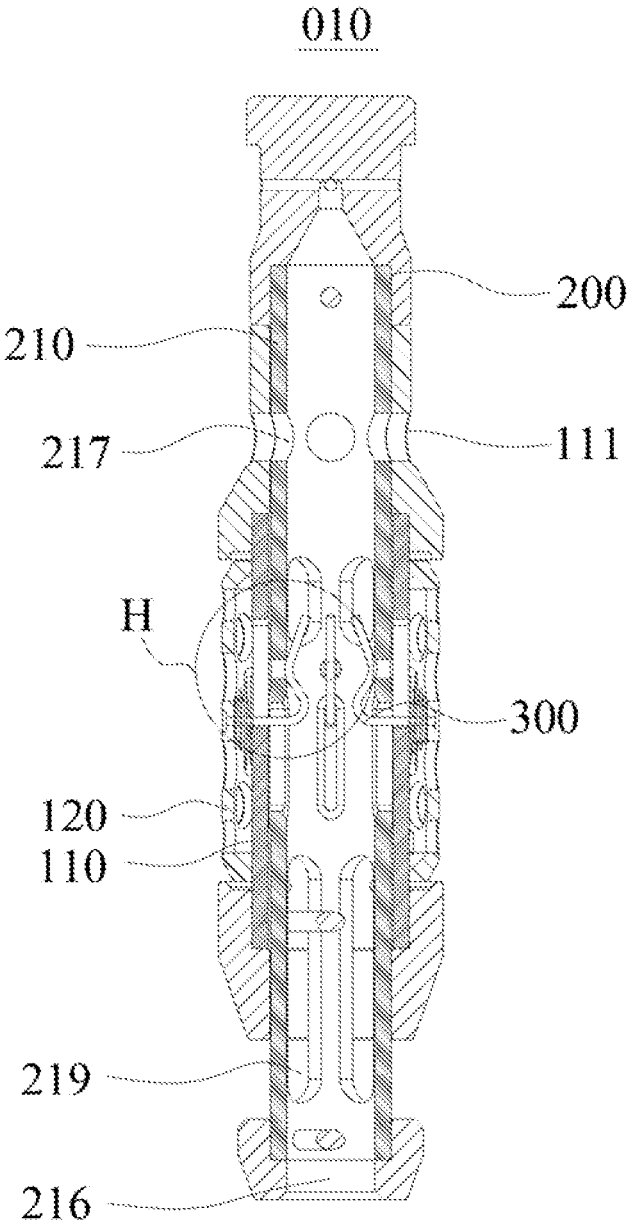
FIG. 21 is a cross-sectional view of the fluid separating device in a contracted state according to the fourth embodiment of the present disclosure.
Figure 22:
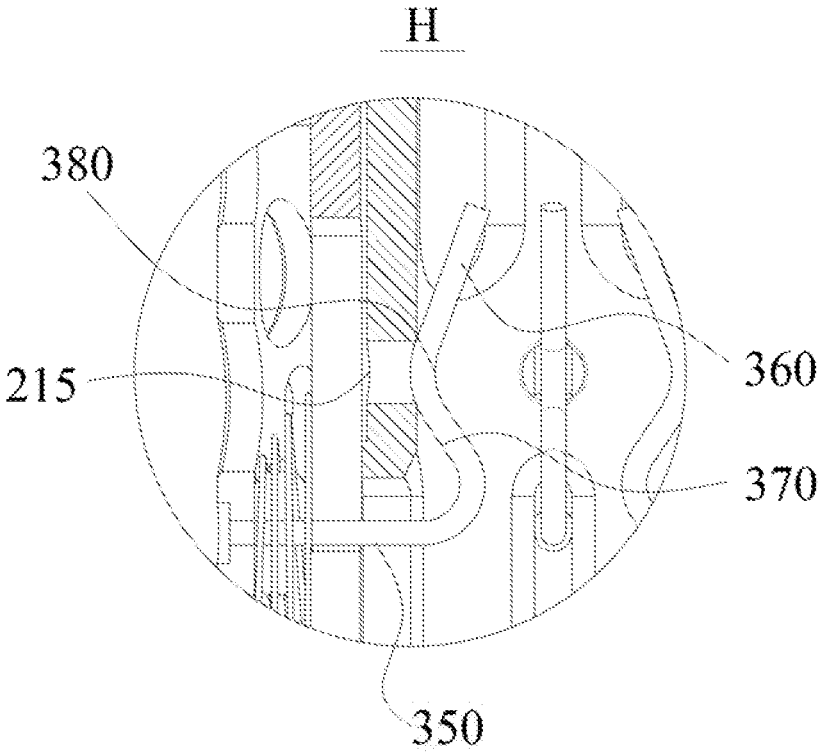
FIG. 22 is an enlarged view of circle H in FIG. 21.

Refer to FIG. 19 through FIG. 22. FIG. 19 is a cross-sectional view of a fluid separating device 010 in an expanded state according to this embodiment. FIG. 20 is an enlarged view of circle G in FIG. 19. FIG. 21 is a cross-sectional view of the fluid separating device 010 in a contracted state according to this embodiment. FIG. 22 is an enlarged view of circle H in FIG. 21.

In this embodiment, the fluid separating device 010 comprises a cylinder 110, a separator 120, a first elastic piece 130, a first guiding device 200 and a second guiding device 300. A plurality of separators 120 are disposed around the cylinder 110. The first elastic piece 130 is disposed between the separator 120 and the cylinder 110, the first elastic piece 130 applies a radially outward elastic force to the separator 120, so that the first separator 120 can move radially outward relative to the cylinder 110. The first guiding device 200 is set through in the cylinder 110 along the axial direction, and is configured to reciprocate between an expanded position (as shown in FIG. 19) and a contracted position (as shown in FIG. 21) along the axial direction of the cylinder 110. The second guiding device 300 penetrates the cylinder 110, one end is connected to the separator 120, and the other end slidably fits with the first guiding device 200 via a fitting surface 100. The fitting surface 100 gradually extends radially inward relative to the cylinder 110 in the direction from the contracted position to the expanded position. When the first guiding device 200 moves to the contracted position, the second guiding device 300 drives the separator 120 to move radially inward relative to the cylinder 110; when the first guiding device 200 moves to the expanded position, the first elastic piece 130 drives the separator 120 to move radially outward relative to the cylinder 110.

Specifically, in this embodiment, the first guiding device 200 comprises a mandrel 210 extending along the axial direction of the cylinder 110, a second chamber 213 is disposed in the mandrel 210, a second long hole 214 extending along the axial direction of the mandrel 210 is disposed on the wall of the second chamber 213. The second guiding device 300 comprises a connecting section 350, a guiding section 360 and a transition section 370; the connecting section 350 is connected to the separator 120, the guiding section 360 and the connecting section 350 are connected by the transition section 370, the transition section 370 gradually extend radially outward relative to the cylinder 110 in the direction from the contracted position to the expanded position. The connection of the guiding section 360 and the transition section 370 forms a positioning protrusion 380. A positioning hole 215 is disposed on the wall of the second chamber 213; when the first guiding device 200 is located in the contracted position, the positioning protrusion 380 is embedded in the positioning hole 215 to maintain the first guiding device 200 in the contracted position. The guiding section 360 passes through the second long hole 214 and enters the second chamber 213; the fitting surface 100 is disposed on the guiding section 360; the fitting surface 100 slidably fits with the edge of one end of the second long hole 214. When the first guiding device 200 moves to the contracted position, under the action of the fitting surface 100 on the guiding section 360, the second guiding device 300 drives the separator 120 to move radially inward. When the first guiding device 200 moves to the expanded position, the first elastic piece 130 drives the separator 120 to move radially outward relative to the cylinder 110.

Figure 23:
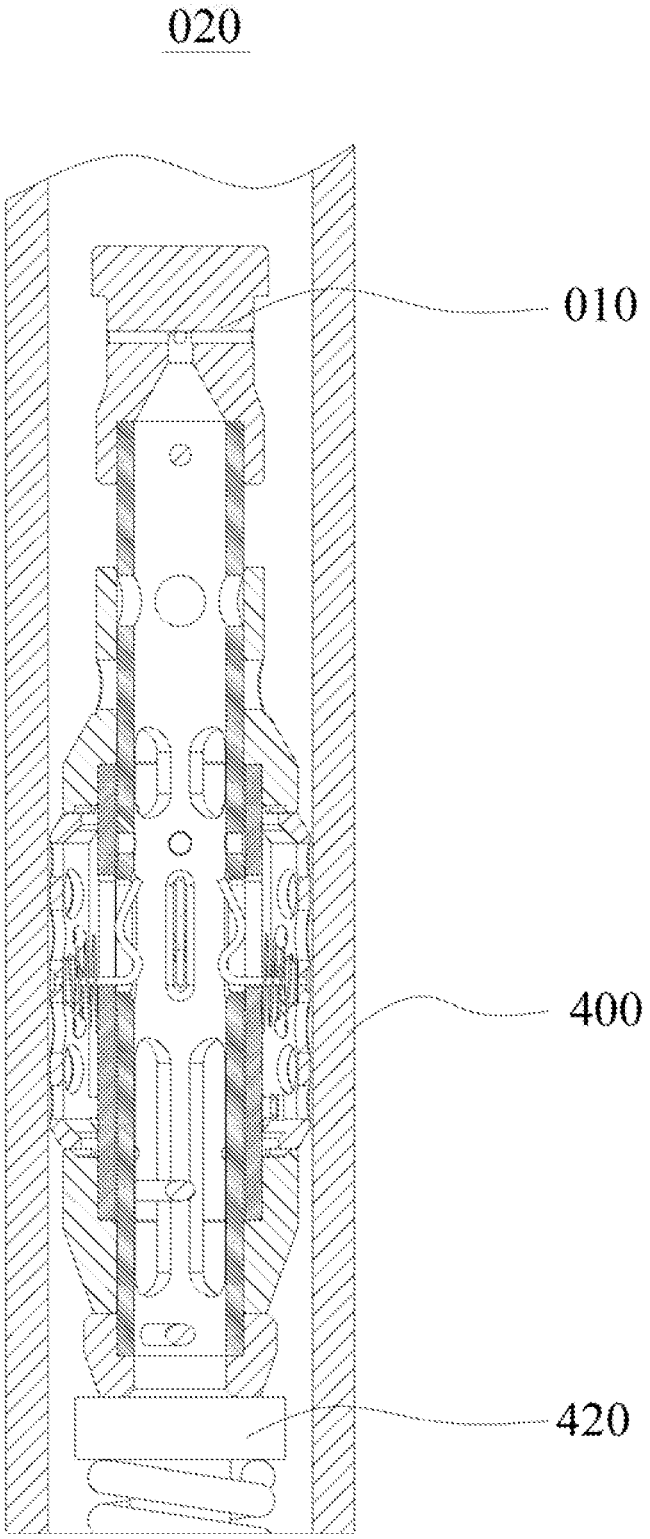
FIG. 23 is a cross-sectional view of a wellhole structure according to the fourth embodiment of the present disclosure.
Figure 24:
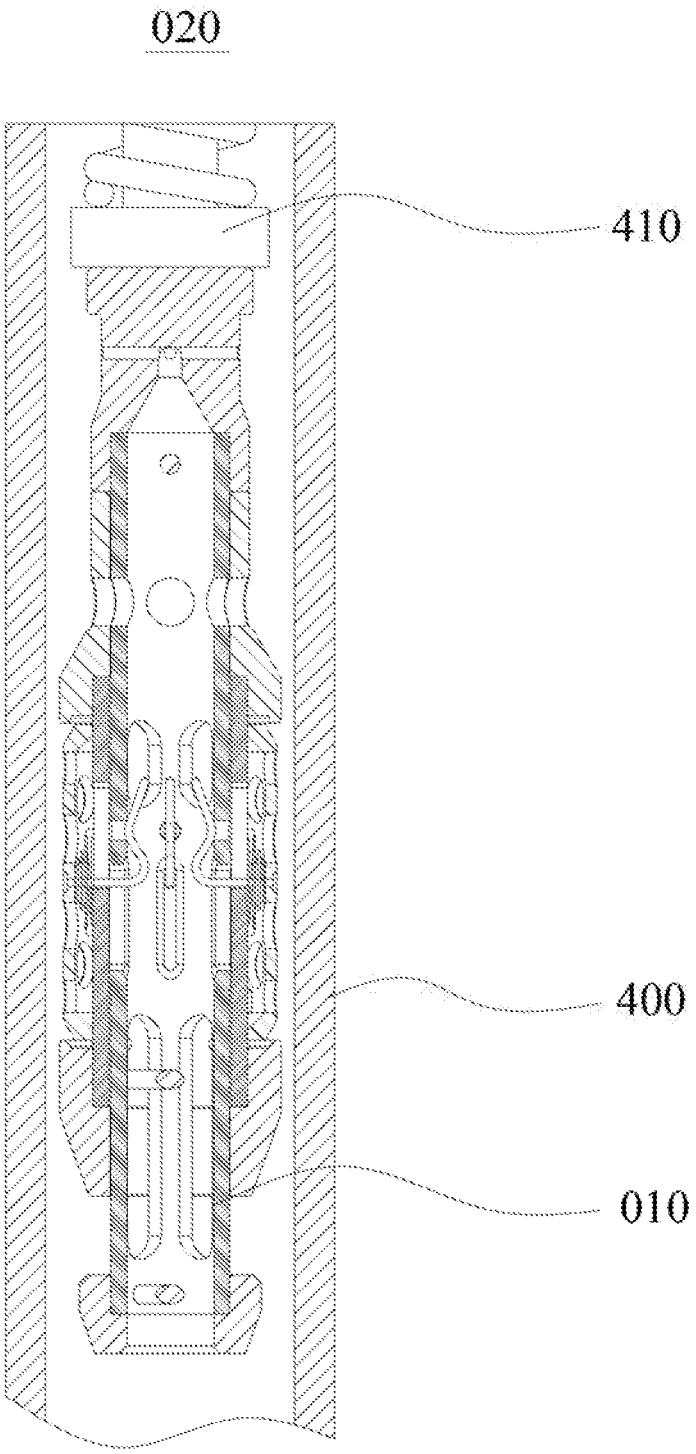
FIG. 24 is another cross-sectional view of the wellhole structure according to the fourth embodiment of the present disclosure.

Refer to FIG. 23 and FIG. 24, this embodiment further provides a wellhole structure 020. The wellhole structure 020 comprises a wellhole 400 and the fluid separating device 010 described above. The upper end of the wellhole 400 is provided with an upper percussion device 410, the lower end of the wellhole 400 is provided with a lower percussion device 420. FIG. 23 is a cross-sectional view of the fluid separating device 010 moving to the lower end of the wellhole 400 and the first guiding device 200 striking the lower percussion device 420, at this time, the first guiding device 200 is located in the expanded position, and the fluid separating device 010 is in the expanded state. FIG. 24 is a cross-sectional view of the fluid separating device 010 moving to the upper end of the wellhole 400 and the first guiding device 200 striking the upper percussion device 410, at this time, the first guiding device 200 is located in the contracted position and the fluid separating device 010 is in the contracted state.

Refer to FIG. 23, when the fluid separating device 010 moves to the lower end of the wellhole 400 and the first guiding device 200 strikes the lower percussion device 420, the positioning protrusion 380 is separated from the positioning hole 215, the first guiding device 200 moves to the expanded position, the first elastic piece 130 drives the separator 120 to move radially outward relative to the cylinder 110, so that the separator 120 is in contact with the inner wall of the wellhole 400. At this time, it is difficult for the oil or natural gas below the fluid separating device 010 to flow above the fluid separating device 010, so the pressure of the oil or natural gas below the fluid separating device 010 increases, which in turn drives the fluid separating device 010 upward. During the upward movement of the fluid separating device 010, the liquid accumulated above the fluid separating device 010 is lifted upward and discharged through the wellhead. When the fluid separating device 010 moves to the upper end of the wellhole 400 and the first guiding device 200 strikes the upper percussion device 410, the first guiding device 200 moves to the contracted position. Under the action of the fitting surface 100 on the guiding section 360, the second guiding device 300 drives the separator 120 to move radially inward, and causes the separator 120 to separate from the inner wall of the wellhole 400, thereby forming an annular gap between the fluid separating device 010 and the wellhole 400. The positioning protrusion 380 is imbedded in the positioning hole 215, so that the first guiding device 200 is maintained in the contracted position. In this way, the friction between the separator 120 and the inner wall of the wellhole 400 is eliminated, and the oil or natural gas below the fluid separating device 010 can flow upward through the annular gap, which reduces the downward resistance to the fluid separating device 010, and enables the fluid separating device 010 to quickly return to the bottom of the well. Even when the well is not shut down, the fluid separating device 010 can quickly descend back to the bottom of the well. At the same time, during the downward movement of the fluid separating device 010, since the friction between the separator 120 and the inner wall of the wellhole 400 is eliminated, the service life of the separator 120 is greatly improved.

In this embodiment, the second guiding device 300 is formed by bending a metal strip; the second guiding device 300 has elasticity at the bend. In this way, when the cylinder 110 and the separators 120 are filled with external objects (sand, paraffin, etc.), which prevent the separator 120 from moving radially inward, the second guiding device 300 can be deformed, so that the first guiding device 200 can move to the contracted position, avoiding violent collision between the first guiding device 200 and the second guiding device 300 to prevent the first guiding device 200 and the second guiding device 300 from being damaged. After the objects filled between the cylinder 110 and the separator 120 are discharged, the separator 120 can move radially inward under the action of the elastic force of the second guiding device 300, so that the fluid separating device 010 is in the contracted state.

Further, in this embodiment, an opening 216 communicating with the second chamber 213 and the outside environment is disposed at the lower end of the mandrel 210; a first through-hole 111 is disposed on the cylinder 110, a second through-hole 217 is disposed on the wall of the second chamber 213; when the first guiding device 200 is located in the contracted position, the first through-hole 111 and the second through-hole 217 communicate with each other, so that the second chamber 213 communicates with the outside environment through the first through-hole 111 and the second through-hole 217. In this way, when the fluid separating device 010 descends, the oil or natural gas below the fluid separating device 010 can flow above the fluid separating device 010 through the opening 216, the second chamber 213, the second through-hole 217, and the first through-hole 111 at one time, which further reduces the downward resistance to the fluid separating device 010 and increases the downward speed of the fluid separating device 010.

Further, in this embodiment, the outer peripheral surface of the mandrel 210 is provided with an annular protrusion 218; the annular protrusion 218 slidably fits with the inner surface of the cylinder 110. In this way, the contact area between the mandrel 210 and the cylinder 110 can be reduced and the movement of the mandrel 210 can be made more sensitive.

Further, in this embodiment, a drain through-hole 219 is disposed on the wall of the second chamber 213 to avoid the formation of a long continuous annular narrow slit between the mandrel 210 and the cylinder 110. The paraffin is easy to accumulate in the long continuous annular narrow slit, which may stick the mandrel 210 and the cylinder 110, and make the relative movement between the mandrel 210 and the cylinder 110 difficult. The drain through-hole 219 enables the paraffin between the mandrel 210 and the cylinder 110 to discharge through the second chamber 213 and the opening 216, which ensures that the relative movement between the mandrel 210 and the cylinder 110 is flexible.

The above description is only a part of the embodiments of the present invention and is not intended to limit the present invention, and for the technicians in this field, the present invention may have various modifications and changes. Any modification, equivalent replacement, improvement, etc. made within the spirit and principle of the present invention should be included in the protection scope of the present invention.

What is claimed is:

1. A fluid separating device, comprising:

a cylinder;

a plurality of separators, disposed around the cylinder;

a first elastic piece, disposed between one of the separators and the cylinder, and applying a first elastic force to the separator outwardly along a radial direction of the cylinder;

a first guiding device, passing through the cylinder axially and configured to reciprocate between an expanded position and a contracted position along an axial direction of the cylinder; and a second guiding device, penetrating the cylinder and connected to the separator at an end thereof and slidably fitted with the first guiding device at another end thereof via a fitting surface, wherein the fitting surface gradually extends radially inward relative to the cylinder in a direction from the contracted position to the expanded position of the first guiding device; when the first guiding device moves to the contracted position, the second guiding device drives the separator to move radially inward relative to the cylinder; and when the first guiding device moves to the expanded position, the first elastic piece drives the separator to move radially outward relative to the cylinder;

the first guiding device comprises a mandrel extending along the axial direction of the cylinder, a part of an outer peripheral surface between two ends of the mandrel forms the fitting surface;

the second guiding device comprises a positioning cylinder, a positioning post, and a second elastic piece: the positioning cylinder is connected to the separator and has a first abutting part; the positioning post passes through the cylinder and is slidably fitted with the positioning cylinder at an end thereof, and slidably fitted with the fitting surface at another end thereof; the second elastic piece is connected to the cylinder, and applies a second elastic force inward to the positioning post along the radial direction of the cylinder;

a second abutting part is disposed at the end of the positioning post with which the positioning cylinder is slidably fitted; when the first guiding device moves to the contracted position, the second elastic piece causes the first abutting part and the second abutting part to abut against each other, and drives the separator to move radially inward relative to the cylinder; and when the first guiding device moves to the expanded position, the first elastic piece drives the separator to move radially outward relative to the cylinder.

2. The fluid separating device of claim 1, wherein a first stop groove is disposed at an end of the fitting surface; when the first guiding device is in the expanded position, the end of the positioning post away from the separator is embedded in the first stop groove;

a second stop groove is disposed at another end of the fitting surface; when the first guiding device is in the contracted position, the end of the positioning post away from the separator is embedded in the second stop groove.

3. A fluid separating device, comprising:

a cylinder;

a plurality of separators, disposed around the cylinder;

a first elastic piece, disposed between one of the separators and the cylinder, and applying a first elastic force to the separator outwardly along a radial direction of the cylinder;

a first guiding device, passing through the cylinder axially and configured to reciprocate between an expanded position and a contracted position along an axial direction of the cylinder; and a second guiding device, penetrating the cylinder and connected to the separator at an end thereof and slidably fitted with the first guiding device at another end thereof via a fitting surface, wherein the fitting surface gradually extends radially inward relative to the cylinder in a direction from the contracted position to the expanded position of the first guiding device; when the first guiding device moves to the contracted position, the second guiding device drives the separator to move radially inward relative to the cylinder; and when the first guiding device moves to the expanded position, the first elastic piece drives the separator to move radially outward relative to the cylinder;

the first guiding device comprises a mandrel extending along the axial direction of the cylinder, a guiding fork is connected to the mandrel, the fitting surface is disposed on the guiding fork;

a guiding hole is disposed at the end of the second guiding device away from the separator to allow the guiding fork to pass through, and an inner surface of the guiding hole slidably fits with the fitting surface;

a first chamber is disposed in the mandrel, a first long hole extending along an axial direction of the mandrel is disposed on a wall of the first chamber; the first long hole is configured to slidably fit with the end of the second guiding device away from the separator to allow the end of the second guiding device away from the separator to enter or leave the first chamber.

4. A fluid separating device, comprising:

a cylinder;

a plurality of separators, disposed around the cylinder;

a first elastic piece, disposed between one of the separators and the cylinder, and applying a first elastic force to the separator outwardly along a radial direction of the cylinder;

a first guiding device, passing through the cylinder axially and configured to reciprocate between an expanded position and a contracted position along an axial direction of the cylinder; and a second guiding device, penetrating the cylinder and connected to the separator at an end thereof and slidably fitted with the first guiding device at another end thereof via a fitting surface, wherein the fitting surface gradually extends radially inward relative to the cylinder in a direction from the contracted position to the expanded position of the first guiding device; when the first guiding device moves to the contracted position, the second guiding device drives the separator to move radially inward relative to the cylinder; and when the first guiding device moves to the expanded position, the first elastic piece drives the separator to move radially outward relative to the cylinder;

the first guiding device comprises a mandrel extending along the axial direction of the cylinder, a second chamber is disposed in the mandrel, a second long hole extending along an axial direction of the mandrel is disposed on a wall of the second chamber;

the second guiding device comprises a connecting section and a guiding section; the connecting section is connected to the separator, the guiding section is connected to the connecting section, the guiding section passes through the second long hole and enters the second chamber; the fitting surface is disposed on the guiding section; and the fitting surface slidably fits with an edge of an end of the second long hole.

5. The fluid separating device of claim 4, wherein the second guiding device further comprises a transition section; the connecting section and the guiding section are connected by the transition section; the transition section gradually extends axially outward relative to the cylinder in a direction from the contracted position to the expanded position of the first guiding device; a positioning protrusion is formed at a connection position between the guiding section and the transition section; and a positioning hole is disposed on the wall of the second chamber; when the first guiding device is located in the contracted position, the positioning protrusion is embedded in the positioning hole.

6. The fluid separating device of claim 5, wherein the second guiding device is formed by bending a metal strip; the second guiding device has elasticity at a bend of the metal strip.

7. The fluid separating device of claim 5, wherein an opening connecting the second chamber to an outside environment is disposed at a lower end of the mandrel; a first through-hole is disposed on the cylinder, and a second through-hole is disposed on the wall of the second chamber; when the first guiding device is in the contracted position, the first through-hole and the second through-hole communicate with each other to cause the second chamber to communicate with the outside environment through the first through-hole and the second through-hole.

8. The fluid separating device of claim 5, wherein the outer peripheral surface of the mandrel is provided with an annular protrusion protruding radially outward; the annular protrusion slidably fits with an inner peripheral surface of the cylinder.

9. The fluid separating device of claim 8, wherein a drain through-hole is disposed on the wall of the second chamber.

* * * * *